US006348307B1

(12) United States Patent
Hioki

(10) Patent No.: US 6,348,307 B1
(45) Date of Patent: Feb. 19, 2002

(54) SILVER HALIDE PHOTOGRAPHIC LIGHT-SENSITIVE MATERIAL

(75) Inventor: Takanori Hioki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/625,324

(22) Filed: Jul. 25, 2000

(30) Foreign Application Priority Data

Jul. 28, 1999 (JP) ..... 11-213977

(51) Int. Cl.[7] ..... G03C 1/12; G03C 1/16; G03C 1/18

(52) U.S. Cl. ..... 430/581; 430/576; 430/577; 430/578; 430/580; 430/583; 430/585; 586/587; 586/588

(58) Field of Search ..... 430/584, 583, 430/576, 577, 578, 580, 585–588, 581

(56) References Cited

U.S. PATENT DOCUMENTS 5,597,687 A * 1/1997 Dobles et al. ..... 430/574
5,604,089 A * 2/1997 Ikegawa et al. ..... 430/584
5,976,779 A * 11/1999 Hioki ..... 430/583

* cited by examiner

*Primary Examiner*—Thorl Chea
(74) *Attorney, Agent, or Firm*—Sughrue Mion, PLLC

(57) ABSTRACT

An object of the present invention is to provide a silver halide photographic light-sensitive material which exhibits a high sensitivity and less residual color. A silver halide photographic light-sensitive material is described, comprising at least one compound represented by the following general formula (I):

(I)

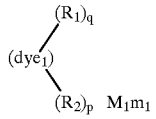

wherein $dye_1$ represents a methine dye; $M_1$ represents a charge-balanced counter ion; $m_1$ represents the number of $M_1$ required to neutralize the charge of the molecule; q and p each represents an integer of 1 or more; $R_1$ represents an alkyl group represented by $R_{1a}$, $R_{1b}$, $R_{1c}$, or $R_{1d}$:

$R_{1a}$: $(Qa)rCON^-SO_2Ra$ $R_{1b}$: $(Qb)sSO_2N^-CORb$ $R_{1c}$: $(Qc)tCON^-CORc$ $R_{1d}$: $(Qd)uSO_2N^-SO_2Rd$ wherein Ra, Rb, Rc and Rd each represents an alkyl group, aryl group, heterocyclic group, alkoxyl group, aryloxy group, heterocyclyloxy group or amino group; Qa, Qb, Qc or Qd each represents a methylene group; and r, s, t and u each represents an integer of 1 or more; and $R_2$ represents an alkyl group represented by the following general formula:

$R_{2a}$: $A_1—SO_3^-$ $R_{2b}$: $A_2—X$ wherein $A_1$ represents a connecting group containing at least one atom other than carbon atom; $A_2$ represents a connecting group; and X represents a carboxyl group, sulfate group, phosphoric acid group or boric acid group.

9 Claims, No Drawings

SILVER HALIDE PHOTOGRAPHIC LIGHT-SENSITIVE MATERIAL

FIELD OF THE INVENTION

The present invention relates to a silver halide photographic light-sensitive material which exhibits a high sensitivity and less residual color.

BACKGROUND OF THE INVENTION

A great deal of effort has been heretofore made to enhance the sensitivity of silver halide photographic light-sensitive materials and minimize residual color after processing.

It is known that a sensitizing dye for use in spectral sensitization has a great effect on the capacities of silver halide photographic light-sensitive materials. Even a small difference in structure between sensitizing dyes has a great effect on photographic capacities such as sensitivity, fogging, storage stability and residual color. However, it is difficult to forecast the effect. Heretofore, many researchers made efforts to synthesize a large number of sensitizing dyes and examine their photographic capacities.

A high aspect ratio tabular silver halide grain (hereinafter referred to as "tabular grain") as disclosed in U.S. Pat. No. 5,494,789 exhibits a great ratio of surface area to volume as one of photographic properties and thus can adsorb a large amount of a sensitizing dye on the surface thereof. As a result, an even higher spectral sensitivity can be obtained.

The term "aspect ratio" as used herein is meant to indicate the ratio of diameter to thickness of tabular grain. The term "diameter of tabular grain" as used herein is meant to indicate the diameter of the circle having the same area as the projected area of the tabular grain as observed under a microscope or electron microscope. The thickness of tabular grain is represented by the distance between the two parallel planes constituting the tabular grain.

Thus, a tabular grain is favorable for providing a high spectral sensitivity. However, a tabular grain is also disadvantageous in that since it adsorbs a large amount of a sensitizing dye, it increases residual color after processing. It has been desired to solve this problem.

For the above reason, a sensitizing dye which provides a high sensitivity and exhibits less residual color has been desired.

SUMMARY OF THE INVENTION

An object of the present invention is to provide a silver halide photographic light-sensitive material which exhibits a high sensitivity and less residual color.

As a result of extensive studies, the foregoing object of the present invention was accomplished by the following aspects (1) to (5) of the present invention:

(1) A silver halide photographic light-sensitive material comprising at least one compound represented by the following general formula (I):

(I)

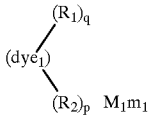

wherein $dye_1$ represents a methine dye; $M_1$ represents a charge-balanced counter ion; $m_1$ represents the number of $M_1$ required to neutralize the charge of the molecule; q and p each represents an integer of 1 or more; $R_1$ represents an alkyl group represented by $R_{1a}$, $R_{1b}$, $R_{1c}$ or $R_{1d}$:

$R_{1a}$: $(Qa)rCON^-SO_2Ra$ $R_{1b}$: $(Qb)sSO_2N^-CORb$ $R_{1c}$: $(Qc)tCON^-CORc$ $R_{1d}$: $(Qd)uSO_2N^-SO_2Rd$ wherein Ra, Rb, Rc and Rd each represents an alkyl group, aryl group, heterocyclic group, alkoxyl group, aryloxy group, heterocyclyloxy group or amino group; Qa, Qb, Qc or Qd each represents a methylene group; and r, s, t and u each represents an integer of 1 or more; and R2 represents an alkyl group represented by the following general formula:

$R_{2a}$: $A_1—SO_3^-$ $R_{2b}$: $A_{2—X}$ wherein $A_1$ represents a connecting group containing at least one atom other than carbon atom; $A_2$ represents a connecting group; and X represents a carboxyl group, sulfate group, phosphoric acid group or boric acid group. (2) The silver halide photographic light-sensitive material according to aspect (1), wherein $A_2$ in $R_2$ represents a connecting group containing at least one atom other than carbon atom. (3) The silver halide photographic light-sensitive material according to aspect (1), wherein the compound represented by the general formula (I) is represented by the following general formula (X):

(X)

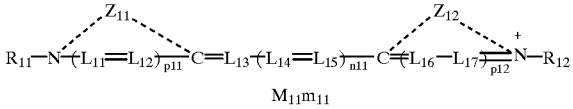

wherein $L_{11}$, $L_{12}$, $L_{13}$, $L_{14}$, $L_{15}$, $L_{16}$ and $L_{17}$ each represents a methine group; $P_{11}$, and $P_{12}$ each represents 0 or 1; $n_{11}$ represents 0, 1, 2 or 3; $Z_{11}$ and $Z_{12}$ each represents an atomic group required to form a 5- or 6-membered nitrogen-containing heterocyclic group, with the proviso that the heterocyclic group may be condensed with aromatic rings; $M_{11}$ represents a charge-balanced counter ion; $m_{11}$ represents a number of from 0 to 4 required to neutralize the charge of the molecule; $R_{11}$ has the same meaning as $R_1$; and $R_{12}$ has the same meaning as $R_2$.

(4) The silver halide photographic light-sensitive material according to aspect (3), wherein $A_2$ in $R_{12}$ represents a connecting group containing at least one atom other than carbon atom.

(5) A silver halide photographic light-sensitive material containing at least one of the compounds represented by the general formula (I) or (X) described in aspects (1) to (4) wherein the silver halide emulsion forming the emulsion layer containing the compound comprises silver halide grains having an aspect ratio of from not less than 3 to not more than 100 in a proportion of 50% or more based on the total projected area of the silver halide grains.

DETAILED DESCRIPTION OF THE INVENTION

The compounds represented by the general formula (I) or (X) used in the present invention will be further described hereinafter.

As the methine dye represented by $dye_1$ there may be used any compound known as such. Preferred examples of such a compound include cyanine dye, merocyanine dye, rhodacyanine dye, oxonol dye, trinuclear merocyanine dye, tetranuclear merocyanine dye, allopolar dye, styryl dye, styrylbase dye, hemicyanine dye, streptocyanine dye, and hemioxonol dye. Preferred among these dyes are cyanine dye, merocyanine dye, trinuclear merocyanine dye, and rhodacyanine dye. Even more desirable among these dyes are cyanine dye, merocyanine dye, and rhodacyanine dye. Particularly preferred among these dyes is cyanine dye. For the details of these dyes, reference can be made to F. M. Harmer, "Heterocyclic Compounds-Cyan Dyes and Related Compounds", John Wiley & Sons, New York, London, (1964), and D. M. Sturmer, "Heterocyclic Compounds-Special Topics in Heterocyclic Chemistry", Chapter 18, Section 14, Clauses 482–515.

Among the preferred methine dyes, the trinuclear merocyanine has one basic nucleus and two acidic nuclei. At least one of three substituents on N-position in each of these nuclei is preferably $R_1$ while at least another substituent is preferably $R_2$. The basic skeleton of the trinuclear merocyanine is preferably one represented by the general formula (I) or (II) disclosed in JP-A-3-171135 (The term "JP-A" as used herein means an "unexamined published Japanese patent application") or the general formula (I) disclosed in JP-A-7-159920.

More preferably, the compound represented by the general formula (I) is one represented by the foregoing general formula (X) or the following general formula (XI) or (XII):

(XI)

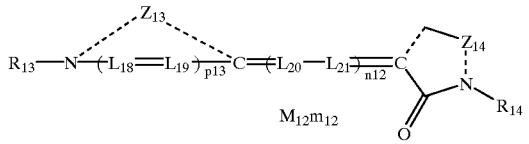

In the general formula (XI), $L_{18}$, $L_{19}$, $L_{20}$ and $L_{21}$, each represents a methine group. The suffix $P_{13}$ represents 0 or 1. The suffix $n_{12}$ represents 0, 1, 2 or 3. $Z_{13}$ and $Z_{14}$ each represents an atomic group required to form a 5- or 6-membered nitrogen-containing heterocyclic group. $M_{12}$ represents a charge-balanced counter ion. The suffix $m_{12}$ represents a number of from 0 to 4 required to neutralize the charge of the molecule. One of $R_{13}$ and $R_{14}$ has the same meaning as $R_1$ and the other has the same meaning as $R_2$.

(XII)

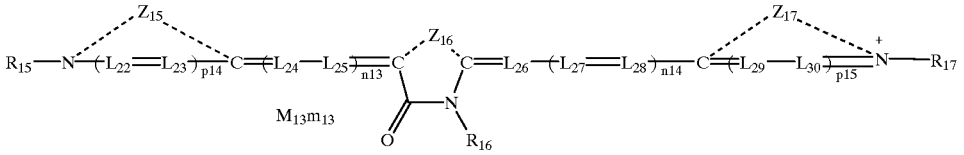

In the general formula (XII), $L_{22}$, $L_{23}$, $L_{24}$, $L_{25}$, $L_{26}$, $L_{27}$, $L_{28}$, $L_{29}$ and $L_{30}$ each represents a methine group. The suffix $P_{14}$ represents 0 or 1. The suffixes $n_{13}$ and $n_{14}$ each represents 0, 1, 2 or 3. $Z_{15}$, $Z_{16}$ and $Z_{17}$ each represents an atomic group required to form a 5- or 6-membered nitrogen-containing heterocyclic group, with the proviso that $Z_{15}$ and $Z_{17}$ may each be condensed with aromatic rings. $M_{13}$ represents a charge-balanced counter ion. The suffix $m_{13}$ represents a number of from 0 to 4 required to neutralize the charge of the molecule. At least one of $R_{15}$ $R_{16}$ and $R_{17}$ has the same meaning as $R_1$, at least another has the same meaning as $R_2$ and the rest represents an alkyl group, aryl group or heterocyclic group.

Preferred among the general formulae (X), (XI) and (XII) are the general formulae (X) and (XI). Even more desirable from these general formulae is the general formula (X).

In $R_1$, Qa, Qb, Qc and Qd each represents an unsubstituted or substituted methylene group. Supposing that the substituent on the methylene group is V, the substituent represented by V is not specifically limited. Examples of the substituent represented by V include halogen atom (e.g., chlorine, bromine, iodine, fluorine), mercapto group, cyano group, carboxyl group, phosphoric acid group, sulfo group, hydroxyl group, carbamoyl group having from 1 to 10, preferably from 2 to 8, more preferably from 2 to 5 carbon atoms (e.g., methylcarbamoyl, ethylcarbamoyl, morpholinocarbonyl), sulfamoyl group having from 0 to 10, preferably from 2 to 8, more preferably from 2 to 5 carbon atoms (e. g., methylsulfamoyl, ethylsulfamoyl, piperidinosulfonyl), nitro group, alkoxy group having from 1 to 20, preferably from 1 to 10, more preferably from 1 to 8 carbon atoms (e.g., methoxy, ethoxy, 2-methoxyethoxy, 2-phenylethoxy), aryloxy group having from 6 to 20, preferably from 6 to 12, more preferably from 6 to 10 carbon atoms (e.g., phenoxy, p-methylphenoxy, p-chlorophenoxy, naphthoxy), acyl group having from 1 to 20, preferably from 2 to 12, more preferably from 2 to 8 carbon atoms (e.g., acetyl, benzoyl, trichloroacetyl), acyloxy group having from 1 to 20, preferably from 2 to 12, more preferably from 2 to 8 carbon atoms (e.g., acetyloxy, benzoyloxy), acylamino group having from 1 to 20, preferably from 2 to 12, more preferably from 2 to 8 carbon atoms (e.g., acetylamino), sulfonyl group having from 1 to 20, preferably from 1 to 10, more preferably from 1 to 8 carbon atoms (e.g. , methanesulfonyl, ethanesulfonyl, benzenesulfonyl) sulfinyl group having from 1 to 20, preferably from 1 to 10, more preferably from 1 to 8 carbon atoms (e.g., methanesulfinyl, benzenesulfinyl), sulfonylamino group having from 1 to 20, preferably from 1 to 10, more preferably from 1 to 8 carbon atoms (e.g., methanesulfonylamino, ethanesulfonylamino, benzenesulfonylamino), amino group, substituted amino group having from 1 to 20, preferably from 1 to 12, more preferably from 1 to 8 carbon atoms (e.g., methylamino, dimethylamino, benzylamino, anilino, diphenylamino), ammonium group having from 0 to 15, preferably from 3 to 10, more preferably from 3 to 6 carbon atoms (e.g., trimethylammonium, triethylammonium), hydrazino group having from 0 to 15, preferably from 1 to 10, more preferably from 1 to 6 carbon atoms (e.g., trimethylhydrazino), ureide group having from 1 to 15, preferably from 1 to 10, more preferably from 1 to 6 carbon atoms (e.g., ureide, N, N-dimethylureide), imide group having from 1 to 15, preferably from 1 to 10, more preferably from 1 to 6 carbon atoms (e.g., succinimide), alkylthio or arylthio group having from 1 to 20, preferably from 1 to 12, more preferably from 1 to 8 carbon atoms (e.g., methylthio, ethylthio, carboxyethylthio, sulfobutylthio, phenylthio), alkoxy-carbonyl group having from 2 to 20, preferably from 2 to 12, more preferably from 2 to 8 carbon atoms (e.g., methoxycarbonyl, ethoxycarbonyl, benzyloxycarbonyl), aryloxycarbonyl group having from 6 to 20, preferably from 6 to 12, more preferably from 6 to 8 carbon atoms (e.g., phenoxycarbonyl), unsubstituted alkyl group having from 1 to 18, preferably from 1 to 10, more preferably 1 to 5 carbon atoms (e.g., methyl, ethyl, propyl, butyl), substituted alkyl group having from 1 to 18, preferably from 1 to 10, more preferably from 1 to 5 carbon atoms (e.g., hydroxymethyl, trifluoromethyl, benzyl, carboxyethyl, ethoxycarbonylmethyl, acetylaminomethyl, including unsaturated hydrocarbon group having from 2 to 18, preferably from 3 to 10, particularly from 3 to 5 carbon atoms (e.g., vinyl, ethynyl, 1-cyclohexenyl, benzylidine, benzylidene)), substituted or unsubstituted aryl group having from 6 to 20, preferably from 6 to 15, more preferably from 6 to 10 carbon atoms (e.g., phenyl, naphthyl, p-carboxyphenyl, p-nitrophenyl, 3,5-dichlorophenyl, p-cyanophenyl, m-fluorophenyl, p-tolyl), and heterocyclic group having from 1 to 20, preferably from 2 to 10, more preferably from 4 to 6 carbon atoms (e.g., pyridyl, 5-methylpyridyl, thienyl, furyl, morpholino, tetrahydro-furfuryl). V may further substitute on these substituents.

Specific examples of the substituted methylene group include methyl group-substituted methylene group, ethyl group-substituted methylene group, phenyl group-substituted methylene group, hydroxy group-substituted methylene group, and methylene group substituted by halogen atom (e.g., chlorine, bromine).

Qa, Qb, Qc and Qd each preferably represents an unsubstituted methylene group.

The suffixes r, s, t and u each represents an integer of 1 or more, preferably from 1 to 18, more preferably 1, 2, 3 or 4, even more preferably 1 or 2, particularly 1. When r, s, t and u each is 2 or more, the methylene group is repeated. However, these methylene groups do not need to be the same.

$R_a$, $R_b$, $R_c$, and $R_d$ each represents an alkyl group, aryl group, heterocyclic group, alkoxy group, aryloxy group, heterocyclyloxy group (meaning oxy group substituted by heterocyclic group) or amino group. In the present invention, any of these groups contains substituents. Preferred examples of these groups include unsubstituted alkyl group having from 1 to 18, preferably from 1 to 10, more preferably from 1 to 5 carbon atoms (e.g., methyl, ethyl, propyl, butyl), substituted alkyl group having from 1 to 18, preferably from 1 to 10, more preferably from 1 to 5 carbon atoms (e.g., hydroxymethyl, trifluoromethyl, benzyl, carboxyethyl, ethoxycarbonylmethyl, acetylaminomethyl, including unsaturated hydrocarbon group having from 2 to 18, preferably from 3 to 10, particularly from 3 to 5 carbon atoms (e.g., vinyl, ethynyl, 1-cyclohexenyl, benzylidine, benzylidene)), substituted or unsubstituted aryl group having from 6 to 20, preferably from 6 to 15, more preferably from 6 to 10 carbon atoms (e.g., phenyl, naphthyl, p-carboxyphenyl, p-nitrophenyl, 3,5-dichlorophenyl, p-cyanophenyl, m-fluorophenyl, p-tolyl), heterocyclic group which may be substituted and has from 1 to 20, preferably from 2 to 10, more preferably from 4 to 6 carbon atoms (e.g., pyridyl, 5-methylpyridyl, thienyl, furyl, morpholino, tetrahydrofurfuryl), alkoxy group having from 1 to 10, preferably from 1 to 8 carbon atoms (e.g., methoxy, ethoxy, 2-methoxyethoxy, 2-hydroxyethoxy, 2-phenylethoxy), aryloxy group having from 6 to 20, preferably from 6 to 12, more preferably from 6 to 10 carbon atoms (e.g., phenoxy, p-methylphenoxy, p-chlorophenoxy, naphthoxy), heterocyclyloxy group having from 1 to 20, preferably from 3 to 12, more preferably from 3 to 10 carbon atoms (e.g., 2-thienyloxy, 2-morpholinoxy), and amino group having from 0 to 20, preferably from 0 to 12, more preferably from 0 to 8 carbon atoms (e.g., amino, methylamino, dimethylamino, ethylamino, diethylamino, hydroxyethylamino, benzylamino, anilino, diphenylamino, morpholino forming ring, pyrrolidino). V may further substitute on these groups.

Preferred among these groups are methyl group, ethyl group, and hydroxyethyl group. Particularly preferred among these groups is methyl group.

Preferred examples of $R_1$ will be given below.

$R_{101}$: $CH_2CON^-SO_2CH_3$
$R_{102}$: $CH_2SO_2N^-COCH_3$
$R_{103}$: $CH_2CON^-COCH_3$
$R_{104}$: $CH_2SO_2N^-SO_2CH_3$
$R_{105}$: $(CH_2)_2CON^-SO_2CH_3$
$R_{106}$: $CH_2CON^-SO_2C_2H_5$
$R_{107}$: $(CH_2)_3CON^-SO_2CH_3$
$R_{108}$: $(CH_2)_3SO_2N^-COCH_3$
$R_{109}$: $(CH_2)_3CON^-COCH_3$
$R_{110}$: $(CH_2)_3SO_2N^-SO_2CH_3$

Among these groups, those having a smaller suffix are preferred. Accordingly, the most desirable among $R_{101}$ to $R_{110}$ is $R_{101}$.

The dissociative groups in $R_1$'s are all represented in dissociated from ($N^-$) but can be in undissociated form (NH). In practice, it is in dissociated or undissociated form depending on the atmosphere such as pH in which the dye is placed.

The dissociative group is usually represented as ($N^-$, $Na^+$) when a cationic compound is present as a counter salt. When undissociated, it is represented in the form of (NH). However, if the cationic compound as a counter salt is considered to be a proton, the dissociative group may be represented in the form of ($N^-$, $H^+$).

$A_1$ in $R_{2a}$ may be any group so far as it is a connecting group (preferably divalent connecting group) having at least one atom other than carbon atom. Preferred examples of the connecting group will be given below.

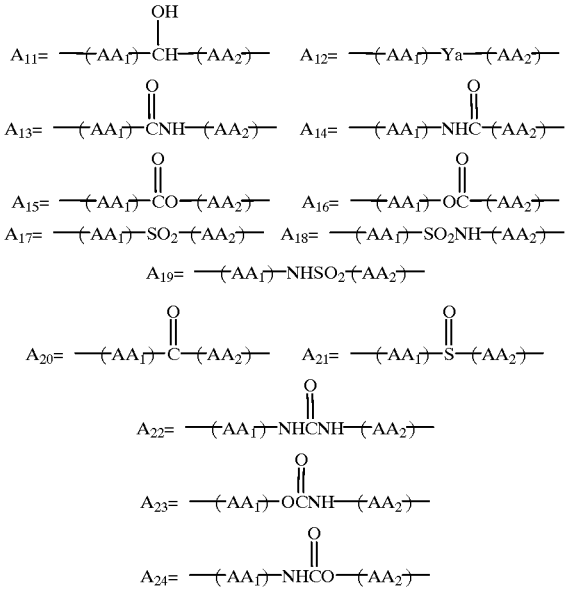

-continued $A_{25}$= —(AA$_1$)—CONHSO$_2$—(AA$_2$)—

$A_{26}$= —(AA$_1$)—CONHCO—(AA$_2$)—

$A_{27}$= —(AA$_1$)—SO$_2$NHCO—(AA$_2$)—

$A_{28}$= —(AA$_1$)—SO$_2$NHSO$_2$—(AA$_2$)—

In the foregoing general formulae, NH may be dissociated to form $N^-$. $AA_1$ and $AA_2$ each represents a divalent connecting group. This connecting group comprises at least one atom or atomic group selected from the group consisting of carbon atom, nitrogen atom, sulfur atom and oxygen atom. Preferably, it represents a divalent connecting group having from 1 to 20 carbon atoms comprising, singly or in combination, an alkylene group (e.g., methylene, ethylene, propylene, butylene, pentylene), an arylene group (e.g., phenylene, naphthylene), an alkenylene group (e.g. ethenylene, propenylene) an alkynylene group (e.g., ethynylene, propionylene), an amido group, an ester group, a sulfamido group, a sulfonic acid ester group, an ureido group, a sulfonyl group, a sulfinyl group, a thioether group, an ether group, an ether group, a carbonyl group, —N(Rq)— (in which Rq represents a hydrogen atom, substituted or unsubstituted alkyl group or substituted or unsubstituted aryl group) and a divalent heterocyclic group (e.g., 6-chloro-1,3,5-triazine-2,4-diyl, pyrimidine-2,4-diyl, quinoxaline-2,3-diyl).

More preferably, the foregoing connecting group is a divalent connecting group having from 1 to 10 carbon atoms comprising, singly or in combination, an alkylene group having from 1 to 4 carbon atoms (e.g., methylene, ethylene, propylene, butylene), an arylene group having from 6 to 10 carbon atoms (e.g., phenylene, naphthylene), an alkenylene group having from 1 to 4 carbon atoms (e.g., ethenylene, propenylene) and an alkynylene group having from 1 to 4 carbon atoms (e.g., ethynylene, propionylene).

Ya represents an oxygen atom, sulfur atom, nitrogen atom (which may be substituted) or selenium atom, preferably an oxygen atom, sulfur atom or nitrogen atom, more preferably an oxygen atom.

Preferred among $A_{11}$ to $A_{28}$ are $A_{11}$ to $A_{16}$. Even more desirable among these groups are $A_{11}$, to $A_{13}$. Particularly preferred among these groups is $A_{11}$. In $A_{11}$, $AA_1$ and $AA_2$ each are preferably methylene.

In $R_{2b}$, $A_2$ may be any group so far as it is a connecting group. In practice, however, it is preferably a divalent connecting group containing at least one atom other than carbon atom. Examples of the divalent connecting group comprising carbon atom alone include alkylene group (e.g., methylene, ethylene, propylene, butylene, pentylene), arylene group (e.g., phenylene, naphthyene), alkenylene group (e.g., ethenylene, propenylene), and alkynylene group (e.g., ethynylene, propionylene). Preferred among these divalent connecting groups is an alkylene group having from 1 to 4 carbon atoms (e.g., methylene, ethylene, propylene, butylene). Particularly preferred among these alkylene groups is methylene.

Preferred examples of the divalent connecting group having at least one atom other than carbon atom include $AA_{11}$ to $AA_{28}$ as previously described as preferred examples of $A_1$.

Preferred among $A_{11}$ to A28 are $A_{11}$ to $A_{16}$. Even more desirable among these groups are $A_{11}$ to $A_{13}$. Particularly preferred among these groups is $A_{13}$. In $A_{13}$, $AA_1$ and $AA_2$ each are preferably methylene.

X represents a carboxyl group, sulfate group, phosphoric acid group or boric acid group, preferably carboxyl group or sulfate group, more preferably carboxyl group. These groups may be either dissociated or undissociated. For example, the carboxyl group and sulfate group are represented in the form of $CO_2^-$ and $OSO_3^-$, respectively, when dissociated, or in the form of $CO_2H$ and $OSO_3H$, respectively, when undissociated.

Further, when log P value of $R_2$ is hydrophilic as described in JP-A-5-13290, pages 4 and 5, the compound is preferred because there is less residual color after processing.

Preferred among $R_{2a}$ and $R_{2b}$ is $R_{2a}$. The suffixes q and p each are preferably an integer of 1 to 4, more preferably 1 or 2, particularly 1.

The 5- or 6-membered nitrogen-containing heterocyclic group represented by $Z_{11}$, $Z_{12}$, $Z_{13}$, $Z_{15}$ or $Z_{17}$ may be condensed with an aromatic ring. The aromatic ring may be a benzene ring, a naphthalene ring or an aromatic heterocyclic ring such as pyrazine ring and thiophene ring.

Preferred examples of the 5- or 6-membered nitrogen-containing heterocyclic group include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, 3,3-dialkylindolenine nucleus (e.g., 3,3-dimethylindolenine), imidazoline nucleus, imdiazole nucleus, benzoimidazole nucleus, 2-pyridine nucleus, 4-pyridine nucleus, 2-quinoline nucleus, 4-quinoline nucleus, 1-isoquinoline nucleus, 3-isoquinoline nucleus, imidazo-[4,5-b]quinoxaline nucleus, oxadiazole nucleus, thiadiazole nucleus, tetrazole nucleus, and pyrimidine nucleus.

Preferred among these 5- or 6-membered nitrogen-containing heterocyclic groups are benzoxazole nucleus, benzothiazole nucleus, benzoimidazole nucleus, and quinoline nucleus. Even more desirable among these 5- or 6-membered nitrogen-containing heterocyclic groups are benzoxazole nucleus, and benzothiazole nucleus. Particularly preferred among these 5- or 6-membered nitrogen-containing heterocyclic groups is benzothiazole nucleus.

The substituents on $Z_{11}$, $Z_{12}$, $Z_{13}$, $Z_{15}$ or $Z_{17}$ are not specifically limited. In practice, however, the foregoing substituents represented by V may be used. These substituents may be condensed with benzene ring, naphthalene ring or anthracene ring. V may further substitute on these substituents.

Preferred examples of the substituents on $Z_{11}$, $Z_{12}$, $Z_{13}$, $Z_{15}$ or Z17 include the foregoing alkyl group, aryl group, alkoxy group, halogen atom, acyl group, cyano group, sulfonyl group and condensed benzene ring. Preferred among these substituents are alkyl group, aryl group, halogen atom, acyl group, sulfonyl group, and condensed benzene ring. Particularly preferred among these substituents are methyl group, phenyl group, methoxy group, fluorine atom, chlorine atom, bromine atom, iodine atom, and condensed benzene ring.

Mostly preferred among these substituents are phenyl group, fluorine atom, chlorine atom, bromine atom, and iodine atom.

The methine group represented by $L_{11}$, $L_{12}$, $L_{16}$, $L_{17}$, $L_{18}$, $L_{19}$, $L_{22}$, $L_{23}$, $L_{29}$ or $L_{30}$ may contain substituents. Examples of the substituents include those described with reference to V. Preferred among these substituents is unsubstituted methine group.

The suffixes $P_{11}$, $P_{12}$, $P_{13}$, $P_{14}$ and $P_{15}$ each represents 0 or 1, preferably 0.

Among $R_{15}$, $R_{16}$ and $R_{17}$, one which is not the same as $R_1$ and $R_2$ may be any of alkyl group, aryl group and heterocyclic group. Examples of these groups include unsubstituted alkyl group having from 1 to 18, preferably from 1 to 7, particularly from 1 to 4 carbon atoms (e.g., methyl, ethyl, propyl, isopropyl, butyl, isobutyl, hexyl, octyl, dodecyl, octadecyl), substituted alkyl group having from 1 to 18, preferably from 1 to 7, particularly from 1 to 4 carbon atoms {e.g., V-substituted alkyl group, preferably aralkyl group (e.g., benzyl, 2-phenylethyl), unsaturated hydrocarbon group (e.g., allyl), hydroxyalkyl group (e.g., 2-hydroxyethyl, 3-hydroxypropyl), carboxyalkyl group (e.g., 2-carboxyethyl, 3-carboxypropyl, 4-carboxybutyl, carboxymethyl), alkoxyalkyl group (e.g., 2-methoxyethyl, 2-(2-methoxyethoxy)ethyl), aryloxyalkyl group (e.g., 2-phenoxyethyl, 2-(1-naphtoxy)ethyl), alkoxycarbonylalkyl group (e.g., ethoxycarbonylethyl, 2-benzyloxycarbonylethyl), aryloxycarbonylalkyl group (e.g., 3-phenoxycarbonylpropyl), acyloxyalkyl group (e.g., 2-acetyloxyethyl), acylalkyl group (e.g., 2-acetylethyl), carbamoylalkyl group (e.g., 2-morpholinocarbonylethyl), sulfamoylalkyl group (e.g., N,N-dimethylcarbamoylmethyl), sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethyl), sulfoalkenyl group, sulfatealkyl group (e.g., 2-sulfateethyl, 3-sulfatepropyl, 4-sulfatebutyl), heterocyclic ring-substituted alkyl group (e.g., 2-(pyrrolidine-2-one-1-yl) ethyl, tetrahydrofurfuryl), alkylsulfonylcarbamoylalkyl group (e.g., methanesulfonylcarbamoylmethyl), acylcarbamoylalkyl group (e.g., acetylcarbamoylmethyl), acylcarbamoylalkyl group (e.g., acetylsulfamoylmethyl), alkylsulfonylsulfamoylalkyl group (e.g., methanesulfonylsulfamoylmethyl)}, unsubstituted aryl group having from 6 to 20, preferably from 6 to 10, particularly from 6 to 8 carbon atoms (e.g., phenyl, 1-naphthyl), substituted aryl group having from 6 to 20, preferably from 6 to 10, particularly from 6 to 8 carbon atoms (e.g., the foregoing V-substituted aryl group such as p-methoxydiphenyl, p-methylphenyl and p-chlorophenyl), unsubstituted heterocyclic group having from 1 to 20, preferably from 3 to 10, particularly from 4 to 8 carbon atoms (e.g., 2-furyl, 2-thienyl, 2-pyridyl, 3-pyrazolyl, 3-isoxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and substituted heterocyclic group having from 1 to 20, preferably from 3 to 10, particularly from 4 to 8 carbon atoms (e.g., the foregoing V-substituted heterocyclic group such as 5-methyl-2-thienyl, 4-methoxy-2-pyridyl).

$M_1$, $M_{11}$ $M_{12}$ and $M_{13}$ are contained in the foregoing general formulae to indicate the presence of cation or anion when they are required to neutralize the ionic charge of the dye. Representative examples of the cation include inorganic cation such as hydrogen ion ($H^+$), alkaline metal ion (e.g., sodium ion, potassium ion, lithium ion) and alkaline earth metal ion (e.g., calcium ion), and organic cation such as ammonium ion (e.g., ammonium ion, tetraalkylammonium ion, pyridinium ion, ethylpyridinium ion). The anion may be either an inorganic or organic anion. Examples of the anion include halogen anion (e.g., fluorine ion, chlorine ion, iodine ion), substituted arylsulfonic acid ion (e.g., p-toluenesulfonic acid ion, p-chlorobenzenesulfonic acid ion), aryldisulfonic acid ion (e.g., 1,3-benzenesulfonic acid ion, 1,5-naphthalenedisulfonic acid ion, 2,6-naphthalenedisulfonic acid ion), alkylsulfuric acid ion (e.g., methylsulfuric acid ion), sulfuric acid ion, thiocyanic acid ion, perchloric acid ion, tetrafluoroboric acid ion, picric acid ion, acetic acid ion, and trifluoromethanesulfonic acid ion. Other dyes having a charge opposite that of ionic polymer or dye may be used. $CO_2^-$ and $SO_3^-$ may be represented in the form of $CO_2H$ and $SO_3H$, respectively, when they have a hydrogen ion as a counter ion, i.e., they are undissociated.

The suffixes $m_1$, $m_{11}$, $m_{12}$ and $m_{13}$ each represents a number required to balance charge, preferably from 0 to 4, particularly 0 in the case where the foregoing cation or anion forms a salt in the molecule.

$Z_{14}$ represents an atomic group required to form an acidic nucleus which may be in the form of any ordinary acidic nucleus of melocyanine dye. The term "acidic nucleus" as used herein is defined, e.g., by James, "The Theory of the Photographic Process", 4th edition, Macmillan, page 198, (1977). Specific examples of the acidic nucleus include those described in U.S. Pat. Nos. 3,567,719, 3,575,869, 3,804,634, 3,837,862, 4,002,480 and 4,925,777, and JP-A-3-167546.

Preferably, the acidic nucleus forms a 5- or 6-membered nitrogen-containing heterocyclic group formed by carbon atom, nitrogen atom and chalocogen atom (representative examples: oxygen, sulfur, selenium, tellurium). Examples of the acidic nucleus include 2-pyrazoline-5-one, pyrazolidine-3,5-dione, imidazoline-5-one, hydantoin, 2-thiohydantoin, 4-thiohydantoin, 2-iminoxazolidine-4-one, 2-oxazoline-5-one, 2-thiooxazoline-2,4-dione, isooxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a] pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido[1,2-a]pyrimidine-1,3-dione, pyrazolo[1,5-b] quinazolone, pyrazolo[1,5-a]benzoimidazole, pyrazolopyridone, 1,2,3,4-tetrahydroquinoline-2,4-dioxide, 3-oxo-2,3-dihydrobenzo[d]thiophene-1,1-dioxide, and 3-dicyanomethine-2,3-dihydrobenzo[d]thio-phene-1,1-dioxixe.

Preferred among the acidic nuclei represented by $Z_{14}$ are hydantoin, 2-thiohydantoin, 4-thiohydantoin, 2-oxazoline-5-one, 2-thiooxazoline-2,4-dione, thiazolidine-2,4-dione, rhodanine, thiazolidine-2,4-dithione, barbituric acid, and 2-thiobarbituric acid. Even more desirable among these acidic nuclei are hydantoin, 2-thiohydantoin, 4-thiohydantoin, 2-oxazoline-5-one, rhodanine, barbituric acid, and 2-thiobarbituric acid. Particularly preferred among these acidic nuclei are 2-thiohydantoin, 4-thiohydantoin, 2-oxazoline-5-one, and rhodanine.

The 5- or 6-membered nitrogen-containing heterocyclic group formed by $Z_{16}$ is a compound obtained by removing oxo group or thioxo group from the heterocyclic group represented by $Z_{14}$. The 5- or 6-membered nitrogen-containing heterocyclic group is preferably a compound obtained by removing oxo group or thioxo group from hydantoin, 2-thiohydantoin, 4-thiohydantoin, 2-oxazoline-5-one, 2-thioxazoline-2,4-dione, thiazolidine-2,4-dione, rhodanine, thiazolidine-2,4-titione, barbituric acid or 2-thiobarbituric acid, more preferably a compound obtained by removing oxo group or thioxo group from hydantoin, 2-thiohydantoin, 4-thiohydantoin, 2-oxazoline-5-one, rhodanine, barbituric acid or 2-thiobarbituric acid, particularly a compound obtained by removing oxo group or thioxo group from 2-thiohydantoin, 4-thiohydantoin, 2-oxazoline-5-one, or rhodanine.

$L_{13}$, $L_{14}$, $L_{15}$, $L_{20}$, $L_{21}$, $L_{24}$, $L_{25}$, $L_{26}$, $L_{27}$ and $L_{28}$ each independently represents a methine group. The methine group may contain substituents. Examples of these substituents include substituted or unsubstituted alkyl group having from 1 to 15, preferably from 1 to 10, more preferably from 1 to 5 carbon atoms (e.g., methyl, ethyl, 2-carboxyethyl), substituted or unsubstituted aryl group having from 6 to 20, preferably from 6 to 15, more preferably from 6 to 10 carbon atoms (e.g., phenyl, o-carboxyphenyl), substituted or unsubstituted heterocyclic group having from 3 to 20, preferably from 4 to 15, more preferably from 6 to 10 carbon atoms (e.g., N,N-diethylbarbituric acid group), halogen atom (e.g., chlorine, bromine, fluorine, iodine), alkoxy group having from 1 to 15, preferably from 1 to 10, more preferably from 1 to 5 carbon atoms (e.g., methoxy, ethoxy), alkylthio group having from 1 to 15, preferably from 1 to 10, more preferably from 1 to 5 carbon atoms (e.g., methylthio, ethylthio), arylthio group having from 6 to 20, preferably from 6 to 15, more preferably from 6 to 10 carbon atoms (e.g., phenylthio) and amino group having from 0 to 15, preferably from 2 to 10, more preferably from 4 to 10 carbon atoms (e.g., N,N-diphenylamino, N-methyl-N-phenylamino, N-methylpiperadino). These substituents may form a ring with other methine groups. Alternatively, these substituents may form a ring with $Z_{11}$, $Z_{12}$, $Z_{13}$, $Z_{15}$ or $Z_{17}$.

The suffixes $n_{11}$, $n_{12}$ and $n_{13}$ each preferably is 0, 1 or 2, more preferably 0 or 1, particularly 1. The suffix $n_{14}$ is preferably 0 or 1, more preferably 0. When $n_{11}$, $n_{12}$, $n_{13}$ and $n_{14}$ each are 2 or more, the methine group is repeated. These methine groups do not need to be the same.

Specific examples of the compound represented by the general formula (I) (including the general formula (X), (XI) or (XII) of lower conception) according to the present invention will be given below, but the present invention should not be construed as being limited thereto.

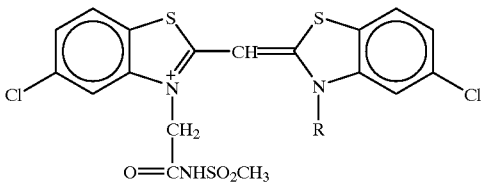

(1) R = $CH_2CH(OH)CH_2SO_3^-$
(2) R = $CH_2CONHCH_2CH_2SO_3^-$
(3) R = $CH_2CO_2^-$
(4) R = $CH_2CONHCH_2CO_2^-$

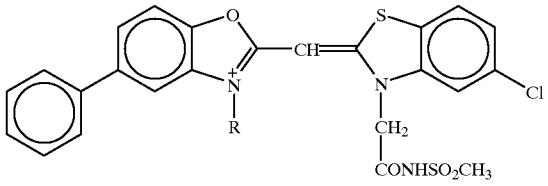

(5) R = $CH_2CH(OH)CH_2SO_3^-$
(6) R = $(CH_2)_2O(CH_2)SO_3^-$
(7) R = $CH_2CO_2^-$
(8) R = $(CH_2)_2O(CH_2)_2CO_2^-$

-continued

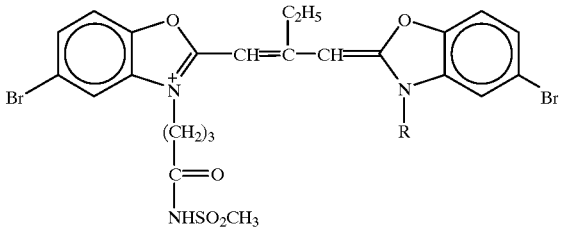

(9) R = $CH_2CH(OH)CH_2SO_3^-$
(10) R = $CH_2CONH(CH_2)_2CO_2^-$

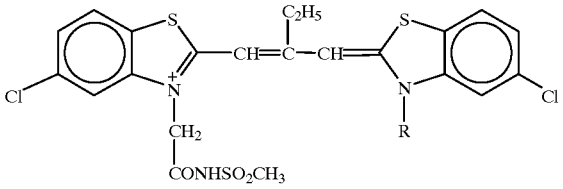

(11) R = $CH_2CH(OH)CH_2SO_3^-$
(12) R = $CH_2CONH(CH_2)_2SO_3^-$
(13) R = $CH_2CO_2^-$
(14) R = $CH_2CONHCH_2CO_2^-$
(15)

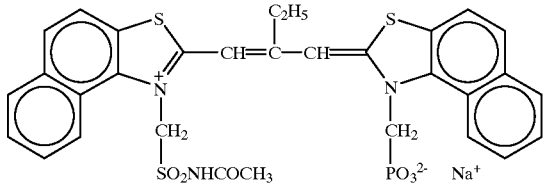

(16)

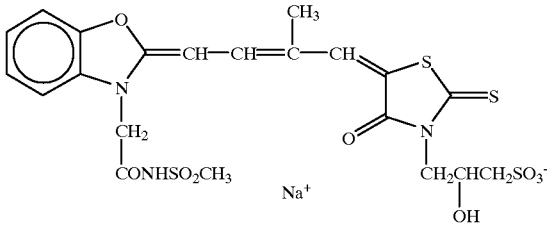

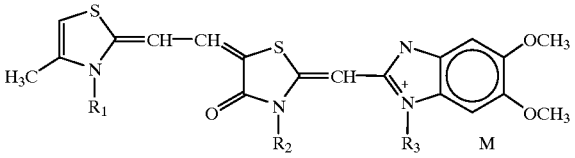

(17) $R_1 = CH_2CH(OH)SO_3^-$, $R_2 = C_2H_5$, $R_3 = CH_2CONHSO_2CH_3$
(18) $R_1 = (CH)_3SO_3^-$, $R_2 = CH_2CO_2^-$, $R_3 = CH_2CONHSO_2CH_3$, $M = Na^+$

-continued

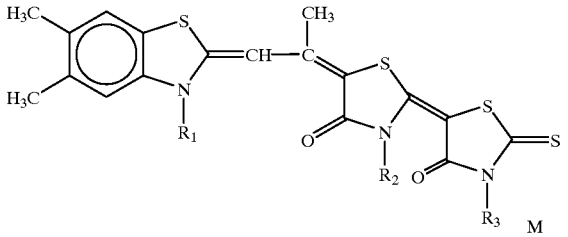

(19) $R_1 = CH_2CONHSO_2CH_3$, $R_2 = R_3 = CH_2CO_2^-$, M=2Na$^+$

(20) $R_1 = CH_2CONHSO_2CH_3$, $R_2 = CH_2CHSO_3^-$, $R_3 = CH_2CO_2^-$, M=2Na$^+$

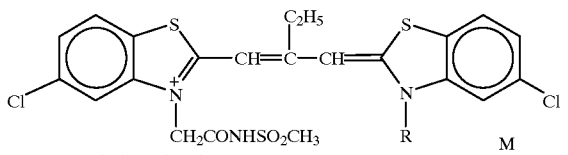

(21) R= $(CH_2)_2OSO_3^-$, M= -

(22) R= $CH_2$— 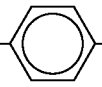 —$B(OH)_2$, M=$Br^-$

The synthesis of the compound represented by the general formula (I) (including dyes of lower conception) according to the present invention can be accomplished by the method described in F. M. Harmer, "Heterocyclic Compounds-Cyanine Dyes and Related Compounds", John Wiley & Sons, New York, London, (1964), D. M. Sturmer, "Heterocyclic Compounds-Special Topics in Heterocyclic Chemistry", Chapter 18, Section 14, pages 482–515, John Wiley & Sons, New York, London, (1977), and "Rodd's Chemistry of Carbon Compounds", 2nd edition, vol. IV, part B, (1977), Chapter 15, pages 369–422, Elsevier Science Publishing Company Inc., New York.

The compound represented by the general formula (I) according to the present invention (including dyes of lower conception; hereinafter collectively referred to as "compound according to the present invention") may be used singly or in combination with other spectral sensitizers.

The silver halide photographic light-sensitive material of the present invention will be further described hereinafter.

The compound according to the present invention (or other sensitizing dyes) may be added to the silver halide emulsion according to the present invention at any step during the preparation of emulsion which has heretofore been considered useful. For example, as disclosed in U.S. Pat. Nos. 2,735,766, 3,628,960, 4,183,756 and 4,225,666, JP-A-58-184142 and JP-A-60-196749, it may be added during the formation of silver halide grains and/or the period before the desalting of silver halide emulsion or during the desalting of silver halide emulsion and/or during the period between after the desalting of silver halide emulsion and before the beginning of chemical ripening of silver halide grains. As disclosed in JP-A-58-113920, it may be added at any time and any step during the period shortly before or during chemical ripening of silver halide grains or during the period between after chemical ripening of silver halide grains and before coating of emulsion. As disclosed in U.S. Pat. No. 4,22-5,666 and JP-A-58-7629, one compound may be added by portions, singly or in combination with other compounds having different structures, e.g., during the formation of grains and during or after the chemical ripening of emulsion or by portions, e.g., before or during and after the chemical ripening of emulsion. The kind of the compound to be added by portions and other compounds to be combined therewith may be varied.

The amount of the compound according to the present invention to be added depends on the shape and size of silver halide grains. In practice, however, it may be from $1\times10^{-6}$ to $8\times10^{-3}$ mols per mol of silver halide. For example, when the size of silver halide grains is from 0.2 to 1.3 $\mu$m, the amount of the compound according to the present invention to be added is preferably from $2\times10^{-6}$ to $3.5\times10^{-3}$ mols, more preferably from $7.5\times10^{-6}$ to $1.5\times10^{-3}$ mols per mol of silver halide.

The compound according to the present invention may be directly dispersed in the emulsion. Alternatively, the compound according to the present invention may be added to the emulsion in the form of solution in a proper solvent such as methyl alcohol, ethyl alcohol, methyl cellosolve, acetone, water, pyridine and mixture thereof. During this operation, an additive such as base, acid and surface active agent may be present in the system. The dissolution of the compound according to the present invention may be assisted by the use of ultrasonic wave. Examples of the method of adding the compound according to the present invention include a method as described in U.S. Pat. No. 3,469,987 which comprises dissolving the compound in an organic volatile solvent, dispersing the solution in a hydrophilic colloid, and then adding the dispersion to the emulsion, a method as described in JP-B-46-24185 (The term "JP-B" as used herein means an "examined Japanese patent application") which comprises dispersing the compound according to the present invention in a water-soluble solvent, and then adding the dispersion to the emulsion, a method as described in U.S. Pat. No. 3,822,135 which comprises dissolving the compound according to the present invention in a surface active agent, and then adding the solution to the emulsion, a method as described in JP-A-51-74624 which comprises dissolving the compound according to the present invention using a red-shifting compound, and then adding the solution to the emulsion, and a method as described in JP-A-50-80826 which comprises dissolving the compound according to the present invention in an acid substantially free of water, and then adding the solution to the emulsion. Alternatively, the addition of the compound according to the present invention to the emulsion can be accomplished by the method described in U.S. Pat. Nos. 2,912,343, 3,342,605, 2,996,287 and 3,429,835.

The compound according to the present invention can be used as filter dye, irradiation-inhibiting dye or antihalation dye for improving sharpness and color resolution.

This compound may be incorporated in the coating solution for silver halide photographic light-sensitive material layer, filter layer and/or antihalation layer by any conventional method. The amount of the dye to be used may be arbitrary so far as it suffices to color the photographic layer. Those skilled in the art can properly predetermine this amount depending on the purpose. In general, this compound is preferably used in an amount such that the resulting optical density ranges from 0.05 to 3.0.

The compound according to the present invention may be added at any step before coating.

A polymer having a charge opposite that of dye ion may be allowed to be present in the layer as a mordant to have mutual interaction with the dye molecule, thereby causing the dye to be localized in a specific layer.

Examples of the polymer mordant employable herein include those described in U.S. Pat. Nos. 2,548,564, 4,124, 386, 3,625, 694, 3,958,995, 4,168,976 and 3,445,231.

Examples of t he supersensitizer useful in the spectral sensitization according to the present invention include pyrimidylamino compound, triazinylamino compound and azolium compound as disclosed in U.S. Pat. Nos. 3,511,664, 3,615,613, 3,615,632, 3,615,641, 4,596,767, 4,945,038, 4,965,182 and 4,965,182. These supersensitizers are preferably used in the manner described in the above cited patents.

The silver halide emulsion and other components which are preferably used in the present invention will be described hereinafter.

Referring to the process for the preparation of the silver halide grains according to the present invention, besides the process which comprises allowing the growth of grains by adding a soluble silver salt and a halogen salt in a predetermined concentration at a constant flow rate, the grain forming process as disclosed in British Patent 1,469,480 and U.S. Pat. Nos. 3,650,757 and 4,242,455 which comprises changing the concentration or flow rate of the components to be added is desirable. By increasing the concentration or flow rate of the components to be added, the amount of silver halide to be supplied can be varied in the form of primary function, secondary function or more complex function. As necessary, the amount of silver halide to be supplied is preferably decreased in some cases. In the case where a plurality of soluble silver salts or soluble halogen salts having different solution compositions are added, it is effective to increase the concentration or flow rate of one of the soluble silver or halogen salts while decreasing that of the others.

During the preparation of the emulsion comprising tabular grains, the flow rate, amount and concentration of the silver salt solution (e.g., aqueous solution of $AgNO_3$) and the halide solution (e.g., aqueous solution of KBr) to be added are preferably raised to expedite the grain growth. For the details of these methods, reference can be made to British Patent 1,335,925, U.S. Pat. Nos. 3,672,900, 3,650,757 and 4,242,445, JP-A-55-142329, and JP-A-55-158124.

The presence of salts of metal ions during the preparation of the emulsion according to the present invention, e.g., during the formation of grains, during the desalting of emulsion, during the chemical sensitization of emulsion or before coating, is preferred depending on the purpose. Thus, the presence of salts of metal ions makes it possible to increase the overexposure that can go without causing re-inversion or lower the minimum allowable density. In order to dope the grains with metal ions, these salts of metal ions are preferably added during the formation of grains. In order to modify the surface of grains with salts of metal ions or use salts of metal ions as a chemical sensitizer, these metal ions are preferably added after the formation of grains and before the termination of chemical sensitization. The grains may be doped with salts of metal ions entirely, in the core alone, in the shell alone, in the epitaxial portion alone or in the substrate alone (The grains according to the present invention may contain an epitaxially grown portion besides the shell). Examples of the metal employable herein include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. Preferred among these metals are Fe, Co, Ru, Ir, Pt, Au, and Pb. Particularly preferred among these metals are Fe, Ru, Ir, and Pb.

Such a metal can be added in the form of salt which can be dissolved during the formation of grains such as ammonium salt, acetate, nitrate, sulfate, phosphate, hydroxide, six-coordinate complex and four-coordinate complex. Examples of these metal salts include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $NH_4RhCl_6$, and $K_4Ru(CN)_6$. The ligand of these coordination compounds can be selected from the group consisting of halide, $H_2O$ cyano, cyanate, nitrosyl, thionitrosyl, oxo and carbonyl. These metal compounds may be used singly or in combination of two or more thereof.

The method which comprises adding a chalogenide compound as described in U.S. Pat. No. 3,772,031 to an emulsion is occasionally useful. Besides S, Se and Te, cyanate, thiocyanate, selenocyanate, carbonate, phosphate or acetate may be present.

For the details of these methods, reference can be made to U.S. Pat. Nos. 2,448,060, 2,628,167, 3,737,313 and 3,772,031, and *Research Disclosure* vol. 134, Item 13452 (June 1975).

The silver halide grains according to the present invention may be in any regular crystal form such as cube, octahedron and tetradecahedron. The silver halide grains according to the present invention, if in the tabular form, may be triangular, hexagonal or circular. A preferred crystal form is a regular hexagon having six sides which are almost the same in length as described in U.S. Pat. No. 4,996,137.

The tabular emulsion which can be preferably used in the present invention is an emulsion comprising silver halide grains containing grains having an aspect ratio (equivalent-circle diameter of silver halide grain/thickness of silver halide grain) of from 3 to 100, preferably from 5 or more, more preferably 8 or more, in a proportion of 50% or more, preferably 60% or more, more preferably 85% or more (by area) based on the total projected area of silver halide grains in the emulsion. The term "equivalent-circle diameter of tabular silver halide grain" as used herein is meant to indicate the equivalent-circle diameter of two opposing main planes which are parallel or almost parallel to each other (diameter of circle having the same projected area as the main plane). The term "thickness of grain" as used herein is meant to indicate the distance between the two opposing main planes. When the aspect ratio of the tabular emulsion exceeds 100, it is disadvantageous in that troubles such as deformation and destruction of emulsion can occur by the step at which the emulsion is completed as a coating substance.

The equivalent-circle diameter of the tabular grain is 0.3 $\mu$m, preferably from 0.3 $\mu$m to 10 $\mu$m, more preferably from 0.5 $\mu$m to 5.0 $\mu$m, even more preferably from 0.5 $\mu$m to 3.0 $\mu$m. The thickness of the tabular grain is less than 1.5 $\mu$m, preferably less than 0.1 $\mu$m, more preferably less than 0.07 $\mu$m.

Also preferred is an emulsion comprising grains having a thickness as uniform as 30% or less as calculated in terms of coefficient of variation of thickness. Another preferred grain is one having a thickness and a distance between twinning planes as defined in JP-A-63-163451.

For the measurement of the diameter and thickness of tabular grain, electron microphotograph of grain can be used as described in U.S. Pat. No. 4,434,226.

The distribution of size of silver halide grains may be arbitrary but is preferably monodisperse. The term "monodisperse system" as used herein is meant to indicate a disperse system having silver halide grains distributed over the range of ±60%, preferably ±40% from the number-average grain size in a proportion of 95% based on the total weight or number of silver halide grains. The term "number-average grain size" as used herein is meant to indicate the number-average value of diameters of projected areas of silver halide grains.

The structure and preparation process of monodisperse tabular grain are described in, e.g., JP-A-63-151618. These monodisperse emulsions may be used in admixture.

The composition of these silver halide grains may be any silver halide selected from the group consisting of silver chloride, silver bromide, silver bromochloride, silver bromoiodide, silver bromochloroiodide and silver chloroiodide. Preferred among these silver halides is silver bromoiodide (preferably silver bromoiodide having a silver iodide content of from 1 to 20 mol-%).

The silver halide grain according to the present invention has phases differing from core to shell. The core of the grain may have a homogeneous or heterogenous silver halide composition. The surface phase of the grain may form an discontinuous layer or continuous laminar structure. The grain may also have a dislocation line.

Two or more of these silver halide grains having different crystal habits, halogen compositions, grain sizes and grain size distributions may be used in combination. These different grains may be incorporated in different emulsion layers and/or the same emulsion layer.

The silver halide emulsion is normally subjected to chemical sensitization. For chemical sensitization, the method as described in H. Frieser, "Die Grundlagen der Photographischen Prozesse mit Silberhalogeniden", Akademische Verlagsgesellschaft, pp. 675–734, (1968).

In some detail, sulfur sensitization method using a sulfur-containing compound reactive with an active gelatin or silver (e.g., thiosulfate, thiourea, mercapto compound, rhodanine), selenium sensitization method, reduction sensitization method using a reducing substance (e.g., stannous salt, amine, hydrazine derivative, formamidinesulfinic acid, silane compound), and noble metal sensitization method using a noble metal compound (e.g., gold complex, complex of metal belonging to the group VIII such as Pt, Ir and Pd) may be used singly or in combination.

As the protective colloid to be used in the preparation of the emulsion according to the present invention there can be used gelatin to advantage. Other hydrophilic colloids may be used.

For example, various synthetic hydrophilic high molecular substances such as protein (e.g., gelatin derivative, graft polymer of gelatin with other high molecular substances, albumin, casein), cellulose derivative (e.g., hydroxyethyl cellulose, carboxymethyl cellulose, cellulosesulfuric acid ester), sucrose derivative (e.g., sodium alginate, starch derivative) and homopolymer or copolymer (e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole) maybe used.

As gelatin there may be used an acid-processed gelatin or an enzyme-processed gelatin as described in Bull. Soc. Sci. Photo. Japan, No. 16, page 30 (1966) besides lime-processed gelatin. Alternatively, hydrolyzate or enzymatic decomposition product of gelatin may be used.

A gelatin contains much impurity ions. A gelatin which has been subjected to ion exchange to have a reduced content of inorganic impurity ions is preferably used.

The coated amount of the light-sensitive silver halide to be used in the present invention is from 1 mg to 10 g/m$^2$ as calculated in terms of silver.

The compound according to the present invention is used in various color and black-and-white silver halide photographic light-sensitive materials, preferably in picture-taking color photographic materials such as color negative photographic material and color reversal photographic material. The present invention will be further described hereinafter with reference to these picture-taking color photographic materials.

The photographic light-sensitive material of the present invention comprises at least one light-sensitive layer provided on the support.

Referring further to the structure of this lamination, a low-sensitivity blue-sensitive layer (BL), a high-sensitivity blue-sensitive layer (BH), a high-sensitivity green-sensitive layer (GH), a low-sensitivity green-sensitive layer (GL), a high-sensitivity red-sensitive layer (RH) and a low-sensitivity red-sensitive layer (RL) may be provided in this order from the remote side-from the support (S) (i.e., BL/BH/GH/GL/RH/RL(S)). An alternate order of lamination is BH/BL/GL/GH/RH/RL(S). A still alternate order of lamination is BH/BL/GH/GL/RL/RH(S).

Alternatively, as described in JP-B-55-34932, a blue-sensitive layer, GH, RH, GL and RL may be provided in this order from the remote side from the support. Still alternatively, as described in JP-A-56-25738 and JP-A-62-63936, a blue-sensitive layer, GL, RL, GH and RH may be provided in this order from the remote side from the support.

Alternatively, as described in JP-B-49-15495, the lamination may be arranged such that a silver halide emulsion layer having the highest sensitivity, a silver halide emulsion layer having a less sensitivity and a silver halide emulsion layer having an even less sensitivity are provided as the uppermost layer, the interlayer and the underlayer, respectively, to form a three-layer structure the sensitivity of which decreases toward the support. As described in JP-A-59-202464, even when three layers having different sensitivities are laminated, a middle sensitivity emulsion layer, a high sensitivity emulsion layer and a low sensitivity emulsion layer may be provided in this order from the remote side from the support in the same spectral sensitivity layer in this order of remoteness from the support.

In order to improve the color reproducibility of the photographic light-sensitive material of the present invention, a donor layer (CL) imparting an interimage effect and having a different spectral sensitization distribution from main light-sensitive layer such as BL, GL and RL as described in U.S. Pat. Nos. 4,663,271, 4,705,744 and 4,707,436, JP-A-62-160448 and JP-A-63-89850 is preferably provided adjacent to or close to the main light-sensitive layer.

As the material for imparting an interimage effect there may be used a compound which reacts with an oxidation product of a developing agent obtained by development to release a development inhibitor or precursor thereof. For example, DIR (development inhibitor-releasing) couplers, DIR-hydroquinones, couplers which release DIR-hydroquinone or precursor thereof, etc. may be used. These compounds can exert an effect of inhibiting development not only diffusively but also in undesirable directions. In order to correct for this undesirable effect, it is preferred that the donor layer be colored (e.g., colored the same color as that of the layer affected by undesirable development inhibitor). In order to obtain spectral sensitivity desired by the photographic light-sensitive material of the invention, it is preferred that the donor layer which imparts an interimage effect be colored magenta.

The size and crystal form of silver halide grains to be incorporated in the layer for providing the red-sensitive layer with an interimage effect are not specifically limited. In practice, however, an emulsion of so-called tabular grains having a high aspect ratio, a monodisperse emulsion having a uniform grain size or an emulsion of silver bromoiodide grains having a laminar iodine structure is preferably used. In order to increase the exposure latitude, two or more emulsions having different grain sizes are preferably used in admixture.

The donor layer for providing the red-sensitive layer with an interimage effect may be provided in any position on the support. In practice, however, the donor layer is preferably provided in a position which is closer to the support than the blue-sensitive layer but farther from the support than the red-sensitive layer. The donor layer is also preferably provided closer to the support than the yellow filter layer.

More preferably, the donor layer for providing the red-sensitive layer with an interimage effect lies in a position closer to the support than the green-sensitive layer but farther from the support than the red-sensitive layer. Most preferably, the donor layer lies adjacent to the green-sensitive layer on the side thereof facing the support. The term "adjacent to" as used is meant to indicate that no interlayer is provided interposed between the two layers.

The layer for providing the red-sensitive layer with an interimage effect may consist of a plurality of layers. In this case, these layers may lie adjacent to or separately of each other.

The emulsion to be incorporated in the photographic light-sensitive material of the present invention may be of the surface latent image type which forms a latent image mainly on the surface thereof or of the internal latent image type which forms a latent image in the interior of grain or of the type which forms a latent image both on the surface and in the interior of grain. The emulsion is preferably a negative-working emulsion. The emulsion, if it is of the internal latent image type, may be a core/shell internal latent image type emulsion as described in JP-A-63-264740. The thickness of the shell of such an emulsion is preferably from 3 to 40 nm, particularly from 5 to 20 nm, though depending on the kind of development to be effected.

The photographic light-sensitive material of the present invention may comprise two or more silver halide light-sensitive emulsions having different at least one characteristic among grain size, grain size distribution, halogen composition, grain shape and sensitivity incorporated in a layer in admixture.

Silver halide grains which have been fogged on the surface thereof as described in U.S. Pat. No. 4,082,553, silver halide grains which have been fogged in the interior thereof as described in U.S. Pat. No. 4,626,498 and JP-A-59-214852 or colloidal silver are preferably applied to a light-sensitive silver halide emulsion layer and/or substantially light-insensitive hydrophilic colloid layer. The term "silver halide grains which have been fogged in the interior or on the surface thereof" as used herein is meant to indicate silver halide grains which can be uniformly (non-imagewise) developed regardless of which they are on the exposed area or on the unexposed area of the light-sensitive material. A process for the preparation of these silver halide grains is described in U.S. Pat. No. 4,626,498 and JP-A-59-214852. The silver halides forming the internal nucleus of the core/shell type silver halide grains which have been fogged in the interior thereof may have different halogen compositions. As the silver halide forming the grains which have been fogged in the interior or on the surface thereof there may be used any of silver chloride, silver bromochloride, silver bromoiodide and silver bromochloroiodide.

The average size of these fogged silver halide grains is preferably from 0.01 μm to 0.75 μm, particularly from 0.05 μm to 0.6 μm. The crystal form of these fogged silver halide grains may be regular. Further, the emulsion may be polydisperse. However, the emulsion is preferably monodisperse (distribution such that at least 95% by weight or number of silver halide grains have a diameter falling within ±40% from the average grain diameter).

In the present invention, a light-insensitive silver halide fine grain is preferably used. A light-insensitive silver halide fine grain is a silver halide fine grain which is not sensitive to light during imagewise exposure by which a dye image is obtained and is not substantially developed during development processing. The light-insensitive silver halide fine grain is not preferably fogged before use. The silver halide fine grain contains silver bromide in an amount of from 0 to 100 mol-% and optionally silver chloride and/or silver iodide. It preferably contains silver iodide in an amount of from 0.5 to 10 mol-%. The silver halide fine grain preferably has an average grain diameter (average value of equivalent-circle diameters of projected areas) of from 0.01 μm to 0.5 μm, more preferably from 0.02 μm to 0.2 μm.

The photographic light-sensitive material according to the present technique comprises the foregoing various additives incorporated therein. Besides these additives, various additives may be used depending on the purpose.

For the details of these additives, reference can be made to *Research Disclosure* Item 17643 (December 1978), Item 18716 (November 1979) and Item 308119 (December 1989). The places at which these descriptions are found are collectively set forth in the table below.

| Kind of additive | RD17643 | RD18716 | RD308119 |
|---|---|---|---|
| 1 Chemical sensitizer | p. 23 | Right column, p. 648 | p. 996 |
| 2 Sensitivity improver | | Right column, p. 648 | |
| 3 Spectral sensitizer, supersensitizer | pp. 23–24 | R.C., p. 648–R.C., p. 649 | R.C., p. 996–R.C., p. 998 |
| 4 Brightening agent | p. 24 | R.C., p. 998 | |
| 5 Fog inhibitor, stabilizer | pp. 24–25 | R.C., p. 649 | R.C., p. 998–R.C., p. 1,000 |
| 6 Light absorber, filter dye, ultra-violet absorber | pp. 25–26 | R.C., p. 649–L.C., p. 650 | L.C., p.1003–R.C., p. 1003 |
| 7 Stain inhibitor | R.C., p. 25 | L.C.–R.C., p. 650 | R.C., p. 1002 |
| 8 Dye image stabilizer | p. 25 | | R.C., p. 1002 |
| 9 Hardener | p. 26 | L.C., p. 651 | R.C., p. 1004–L.C., p. 1005 |
| 10 Binder | p. 26 | L.C., p. 651 | R.C., p. 1003–R.C., p. 1004 |
| 11 Plasticizer, lubricant | p. 27 | R.C., p. 650 | L.C., p. 1006–R.C., p. 1006 |
| 12 Coating aid, surface active agent | pp. 26–27 | R.C., p. 650 | L.C., p. 1005–L.C., p. 1006 |
| 13 Antistatic agent | p. 27 | R.C., p. 650 | R.C., p. 1006–L.C., p. 1007 |
| 14 Matting agent | | | L.C., p. 1008–L.C., p. 1009 |

For the details of technique such as layer structure, silver halide emulsion, functional couplers such as dye-forming coupler and DIR coupler, various additives and development processing which can be applied to the emulsion according to the present invention and the photographic light-sensitive material comprising the emulsion, reference can be made to European Patent No. 0565096A1 (disclosed Oct. 13, 1993) and patents cited therein. These properties and the places at which they are found will be listed below.

1. Layer structure: Lines 23–35, p. 61, line 41, p. 61—line 14, p. 62
2. Interlayer: Lines 36–40, p. 61
3. Interimage effect-providing layer: Lines 15–18, p. 62
4. Halogen composition of silver halide: Lines 21–25, p.62
5. Crystal habit of silver halide grains: Lines 26–30, p.62
6. Size of silver halide grains: Lines 31–34, p.62
7. Process for the preparation of emulsion: Lines 35–40, p.62
8. Distribution of size of silver halide grains: Lines 41–42, p. 62

9. Tabular grains: Lines 43–46, p.62
10. Internal structure of grains: Lines 47–53, p.62
11. Type of formation of latent image on emulsion: Line 54, p.62—line 5, p.63
12. Physical ripening/chemical sensitization of emulsion: Lines 6–9, p.63
13. Use of emulsions in admixture: Lines 10–13, p.63
14. Fogged emulsion: Lines 14–31, p.63
15. Light-insensitive emulsion: Lines 32–43, p.63
16. Coated amount of silver: Lines 49–50, p.63
17. Formaldehyde scavenger: Lines 54–57, p.64
18. Mercapto-based fog inhibitor: Lines 1–2, p. 65
19. Fogging agent-releasing agent: Lines 3–7, p.65
20. Dye: Lines 7–10, p. 65
21. Color coupler (general): Lines 11–13, p.65
22. Yellow, magenta and cyan couplers: Lines 14–25, p.65
23. Polymer coupler: Lines 26–28, p.65
24. Diffusible dye-forming coupler: Lines 29–31, p.65
25. Colored coupler: Lines 32–38, p.65
26. Functional coupler (general): Lines 39–44, p.65
27. Bleach accelerator-releasing coupler: Lines 45–48, p.65
28. Development accelerator-releasing coupler: Lines 49–53, p.65
29. Other DIR couplers: Line 54, p.65—line 4, p.66
30. Method for dispersing coupler: Lines 5–28, p.66
31. Preservative/mildproofing agent: Lines 29–33, p.66
32. Kind of photographic light-sensitive material: Lines 34–36, p.66
33. Thickness and swelling rate of light-sensitive layer: Line 40, p.66—line 1, p.67
34. Back layer: Lines 3–8, p.67
35. Development process (general): Lines 9–11, p.67
36. Developer and developing agent: Lines 12–30, p.67
37. Developer additive: Lines 31–44, p.67
38. Reversal processing: Lines 45–56, p.67
39. Opening of processing solutions: Line 57, p.67—line 12, p.68
40. Development time: Lines 13–15, p.68
41. Blix, bleach, fixing: Line 16, p.68—line 31, p.69
42. Automatic developing machine: Lines 32–40, p.69
43. Washing with water, rinsing, stabilization: Line 41, p.69—line 18, p.70
44. Replenishment and reuse of processing solutions: Lines 19–23, p.70
45. Incorporation of developing agent into photographic light-sensitive material: Lines 24–33, p.70
46. Development processing temperature: Lines 34–38, p. 70
47. Application to film with lens: Lines 39–41, p.70

Further, a bleaching solution containing 2-pyridinecarboxylic acid or 2,6-pyridinecarboxylic acid, a ferric salt such as ferric nitrate and a persulfate as described in European Patent No. 602600 may be preferably used. For the use of this bleaching solution, a stop step and a rinsing step are preferably provided between the color development step and the bleaching step. As the stop solution there is preferably used an organic acid such as acetic acid, succinic acid and maleic acid. This bleaching solution preferably further comprises an organic acid such as acetic acid, succinic acid, maleic acid, glutaric acid and adipic acid incorporated therein in an amount of from 0.1 to 2 mols/litter for the purpose of adjusting pH or effecting bleach fogging.

Examples of the processing agent which can be preferably used for color reversal films containing the aforementioned contents include Type E-6 processing agent available from Eastman Kodak and Type CR-56 processing agent available from Fuji Photo Film Co., Ltd.

The magnetic recording layer which can be preferably used in the present invention will be further described hereinafter.

The magnetic recording layer which can be preferably used is obtained by applying an aqueous or organic solvent-based coating solution comprising a magnetic powder dispersed in a binder to a support.

As the magnetic powder to be used in the present invention there may be used ferromagnetic iron oxide such as $\gamma$-$Fe_2O_3$, Co-coated$\gamma$-$Fe_2O_3$, Co-coatedmagnetite, Co-containingmagnetite, ferromagnetic chromium dioxide, ferromagnetic metal, ferromagnetic alloy, hexagonal Ba ferrite, Sr ferrite, Pb ferrite or Ca ferrite. Preferred among these magnetic powders is Co-coated ferromagnetic iron oxide such as Co-coated $\gamma$-$Fe_2O_3$. The shape of the magnetic powder may be any of needle, rice grain, sphere, cube and tablet. The specific surface area of the magnetic powder is preferably 20 $m^2/g$ or more, particularly 30 $m^2/g$ or more as obtained from surface area calculated in accordance with BET method ($S_{BET}$).

As the binder for magnetic powder there may be used a thermoplastic resin, thermosetting resin, radiation-curing resin, reactive resin, acid-decomposable, alkali-decomposable or biodegradable polymer or natural polymer (e.g., cellulose derivative, sugar derivative) as described in JP-A-4-219569 or mixture thereof.

The magnetic recording layer may be provided with functions such as improvement of lubricity, adjustment of curling properties, inhibition of charging, inhibition of adhesion and polishing of head in combination. Alternatively, the magnetic recording layer may be provided with other functional layers to have these functions in addition. At least one of the grains constituting the magnetic recording layer is preferably an inorganic nonspherical abrasive grain having a Mohs hardness of 5 or more. Preferred examples of the composition of inorganic nonspherical grains include oxides such as aluminum oxide, chromium oxide, silicon dioxide and titanium dioxide, carbides such as silicon carbide and titanium carbide and fine grains such as diamond.

The polyester support which can be preferably used in the present invention will be further described hereinafter. For the details of polyester support in addition to photographic light-sensitive material, processing process, cartridge and examples, reference can be made to Kokai Giho No. 94-6023 (Mar. 15, 1994, Japan Institute of Invention and Innovation). The polyester to be used in the present invention is formed by diol and aromatic dicarboxylic acid as essential components. Examples of the aromatic dicarboxylic acid include 2,6-naphthalenedicarboxylic acid, 1,5-naphthalenedicarboxylic acid, 1,4-naphthalenedicarboxylic acid, 2,7-naphthalene-dicarboxylic acid, terephthalic acid, isophthalic acid, and phthalic acid. Examples of the diol include diethylene glycol, triethylene glycol, cyclohexanedimethanol, bisphenol A, and bisphenol. Examples of the polymer thus formed include homopolymers such as polyethylene terephthalate, polyethylene naphthalate and polycyclohexanedimethanol terephthalate. Particularly preferred among these polymers is polyester containing 2,6-naphthalenedicarboxylic acid in an amount of from 50 mol-% to 100 mol-%. Even more desirable among these polymers is polyethylene-2,6-naphthalate. The average molecular weight of the polyester is from about 5,000 to 200,000. Tg of the polyester to be used in the present invention is 50° C. or higher, preferably 90° C. or higher.

The polyester support is subjected to heat treatment at a temperature of from not lower than 40° C. to lower than Tg, preferably from not lower than (Tg−20° C.) to lower than Tg, so that it can be rendered little apt to curl.

In the present invention, an antistatic agent is preferably used. Examples of such an antistatic agent include high molecular compound containing carboxylic acid, carboxylate or sulfonate, cationic high molecular compound, and ionic surface active agent compound.

Most desirable examples of the antistatic agent include fine grains of at least one crystalline metal oxide selected from the group consisting of ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and a grain size of from 0.001 to 1.0 μ, composite thereof with Sb, P, B, In, S, Si, C, etc., sol-like metal oxide, and fine grains of composite thereof.

The photographic light-sensitive material of the present invention preferably contains a matting agent. The matting agent may be present on either the emulsion side or the back side of the photographic light-sensitive material. In practice, however, it is particularly preferred that the matting agent be incorporated in the outermost layer on the emulsion side. The matting agent may be either soluble or insoluble in the processing solution. Preferably, both the matting agents are used in combination. For example, a polymethyl methacrylate, a poly(methyl methacrylate/methacrylatic acid=9/1 or 5/5 (by mol)), a polystyrene, etc. are preferably used in grain form. The grain diameter of the matting agent is preferably from 0.8 μm to 10 μm. The distribution of grain diameters is preferably narrower. It is preferred that 90% or more of all the grains have a grain diameter falling within the range of from 0.9 to 1.1 times the average grain diameter. In order to improve the matting properties of the matting agent, a fine grain having a size of 0.8 μm or less is preferably added at the same time. Examples of such a fine grain include polymethyl methacrylate fine grain (0.2 μm), poly (methyl methacrylate/methacrylic acid=9/1 (by mol); 0.3 μm)) fine grain, polystyrene fine grain (0.25 μm), and colloidal silica (0.03 μm).

The color photographic material of the present invention can be used as a negative film for advanced photo system (hereinafter referred to as "AP system"). Examples of such a system include a system obtained by working a film into AP system format, and then receiving it in a dedicated cartridge as in NEXIA A, NEXIA F and NEXIA H (ISO 200/100/400, respectively) produced by Fuji Photo Film Co., Ltd. (hereinafter referred to as "Fuji Film"). Such an AP system cartridge film is received in AP system camera such as Epion Series (Epion 300Z, etc.) produced by Fuji Film. The color photographic material of the present invention is also suitable for film with lens such as "Fuji Color Utsurundesu-Superslim" produced by Fuji Film.

The film which has been thus subjected to picture taking is then subjected to printing by a minilaboratory system.

Preferred examples of such a minilaboratory system include Fuji Film Minilaboratory Champion Super FA-298/FA-278/FA-258/FA-238, and Fuji Film Digital Laboratory System Frontier. Examples of the film processor for minilaboratory champion include FP922AL/FP562B/FP562B, AL/FP362B/FP362B, and AL. Recommended examples of the processing agent include Fuji Color Just-it CN-16L and CN-16Q. Examples of printer processors include PP3008AR/PP3008A/PP1828AR/PP1828A/-PP1258AR/PP1258A/PP728AR/PP728A. Recommended examples of the processing agent include Fuji Color Just-it CP-47L and CP-40FAIL. In Frontier System, a scanner & image processor SP-1000 and a laser printer & paper processor LP-1000P or laser printer LP-1000W are used. As a detacher to be used in the detachment step and a reattacher to be used in the reattachment step there are preferably used DT200/DT100 and AT200/AT100 produced by Fuji Film, respectively.

The present invention will be further described in the following examples, but the present invention should not be construed as being limited thereto.

EXAMPLE 1

Emulsions 1, 2 and 3 were prepared in the following manner.

(1) Preparation of Emulsion 1

To an aqueous solution containing a gelatin having an average molecular weight of 15,000 (containing 1,200 ml of water, 7.0 g of gelatin and 4.5 g of KBr) which had been kept at a temperature of 30° C. were added a 1.9 M aqueous solution of $AgNO_3$ and a 1.9 M aqueous solution of KBr by a double jet process at a flow rate of 25 ml/min for 70 seconds with stirring to obtain tabular grain nuclei. To 400 ml out of the emulsion thus obtained as seed crystal was then added 650 ml of an aqueous solution of an inert gelatin (containing 20 g of gelatin and 1.2 g of KBr). The emulsion was heated to a temperature of 75° C. where it was then ripened for 40 minutes. To the emulsion thus ripened was then added an aqueous solution of $AgNO_3$ (containing 1.7 g of $AgNO_3$) in 1 minute and 30 seconds. Subsequently, to the emulsion were added 7.0 ml of a 50 wt-% aqueous solution of $NH_4NO_3$ and 7.0 ml of 25 wt-% $NH_3$. The emulsion was further ripened for 40 minutes.

Subsequently, the emulsion was adjusted with 3 N $HNO_3$ to pH 7. To the emulsion was then added 1.0 g of KBr. To the emulsion were then added 366.5 ml of a 1.9 M aqueous solution of $AgNO_3$ and an aqueous solution of KBr. Subsequently, to the emulsion were added 53.6 ml of a 1.9 M aqueous solution of $AgNO_3$ and an aqueous solution of KBr (containing 33.3 mol-% of KI). To the emulsion were then added 160.5 ml of a 1.9 M aqueous solution of $AgNO_3$ and an aqueous solution of KBr while pAg was being kept at 7.9 to obtain Emulsion 1.

Emulsion 1 thus obtained comprised triple-structured grains each having a middle shell having a region the silver iodide content of which is highest. The average aspect ratio of these grains was 2.8. The tabular grains having an aspect ratio of 3 or more accounted for 26% of the total projected area. The coefficient of variation of grain size was 7%. The average of equivalent-sphere grain size was 0.98 μm.

Emulsion 1 thus obtained was desalted by an ordinary flocculation method. To the emulsion thus desalted was then added a sensitizing dye in an amount of $4.1\times10^{-4}$ mol per mol of silver. The emulsion was then optimally subjected to gold.sulfur.selenium sensitization in the presence of the sensitizing dye.

(2) Preparation of Emulsion 2

To an aqueous solution containing a gelatin having an average molecular weight of 15,000 (containing 1,200 ml of water, 7.0 g of gelatin and 4.5 g of KBr) which had been kept at a temperature of 30° C. were added a 1.9 M aqueous solution of $AgNO_3$ and a 1.9 M aqueous solution of KBr by a double jet process at a flow rate of 25 ml/min for 70 seconds with stirring to obtain tabular grain nuclei. To 350 ml out of the emulsion thus obtained as seed crystal was then added 650 ml of an aqueous solution of an inert gelatin (containing 20 g of gelatin and 1.2 g of KBr). The emulsion was heated to a temperature of 75° C. where it was then ripened for 40 minutes. To the emulsion thus ripened was then added an aqueous solution of $AgNO_3$ (containing 1.7 g of $AgNO_3$) in 1 minute and 30 seconds. Subsequently, to the emulsion were added 6.2 ml of a 50 wt-% aqueous solution of $NH_4NO_3$ and 6.2 ml of 25 wt-% $NH_3$. The emulsion was further ripened for 40 minutes.

Subsequently, the emulsion was adjusted with 3 N $HNO_3$ to pH 7. To the emulsion was then added 1.0 g of KBr. To the emulsion were then added 366.5 ml of a 1.9 M aqueous solution of $AgNO_3$ and an aqueous solution of KBr. Subsequently, to the emulsion were added 53.6 ml of a 1.9 M aqueous solution of $AgNO_3$ and an aqueous solution of KBr (containing 33.3 mol-% of KI). To the emulsion were then added 160.5 ml of a 1.9 M aqueous solution of $AgNO_3$ and an aqueous solution of KBr while pAg was being kept at 8.3 to obtain Emulsion 2.

Emulsion 2 thus obtained comprised triple-structured grains each having a middle shell having a region the silver iodide content of which is highest. The average aspect ratio of these grains was 6.7. The tabular grains having an aspect ratio of 6 or more accounted for 80% of the total projected area. The tabular grains having an aspect ratio of from 3 to 100 accounted for 95% of the total projected area. The coefficient of variation of grain size was 11%. The average of equivalent-sphere grain size was 1.00 $\mu$m.

Emulsion 2 thus obtained was desalted by an ordinary flocculation method. To the emulsion thus desalted was then added a sensitizing dye in an amount of $5.4\times10^{-4}$ mol per mol of silver. The emulsion was then optimally subjected to gold·sulfur·selenium sensitization in the presence of the sensitizing dye.

(3) Preparation of Emulsion 3

To 1.5 1 of a 0.8% aqueous solution of a low molecular gelatin (molecular weight: 10,000) containing 0.05 mols of potassium bromide were added 15 ml of a 0.5 M solution of silver nitrate and 15 ml of a 0.5 M solution of potassium bromide at a double jet process with stirring for 15 seconds. During this procedure, the gelatin solution was kept at a temperature of 40° C. The resulting gelatin solution exhibited a pH value of 5.0. The emulsion was then heated to a temperature of 75° C. To the emulsion was then added 220 ml of a 10% solution of trimellitated gelatin (percent trimellitation: 95%). The emulsion was then ripened for 20 minutes. Thereafter, to the emulsion was added 80 ml of a 0.47 M solution of silver nitrate.

The emulsion was then further ripened for 10 minutes. To the emulsion were then added 150 g of silver nitrate and a potassium bromide solution containing 5 mol-% of potassium iodide at an accelerated flow rate (flow rate at the end of procedure was 19 times that at the beginning of procedure) in an amount such that pBr was kept at 2.55 by a controlled double jet process while the potential was being kept at 0 mV. After the termination of addition, to the emulsion was then added 30 ml of a 10% solution of KI. Thereafter, to the emulsion was added 1 N NaOH so that the pH value thereof was 7.2. To the emulsion were then added 327 ml of a 0.5 M solution of silver nitrate and 16.4 ml of a $10^{-2}$ M solution of potassium ferrocyanate. To the emulsion was then added 327 ml of a 0.5 M solution of potassium bromide by a controlled double jet process in 20 minutes at a potential of 0 mV (formation of shell). Thereafter, the emulsion was cooled to a temperature of 35° C. The emulsion was then rinsed by an ordinary flocculation method. To the emulsion were then added 80 g of a deionized alkali-processed ossein gelatin and 40 ml of 2% $Zn(NO_3)_2$ at a temperature of 40° C. to make a solution. The solution was then adjusted to pH 6.5 and pAg 8.6. The emulsion was then stored in a cold and dark place.

The coefficient of variation of diameter of the tabular grains as calculated in terms of circle having the same area as the projected area (hereinafter referred to as "equivalent-circle diameter") was 15%. The equivalent-circle diameter of the tabular grains was 2.5 $\mu$m. The average thickness of the tabular grains was 0.10 $\mu$m (aspect ratio: 25). The tabular grains were composed of silver bromoiodide containing 5.7 mol-% of silver iodide.

Emulsion 3 thus obtained was then desalted by an ordinary flocculation method. To the emulsion thus desalted was then added a sensitizing dye in an amount of $9.3\times10^{-4}$ mol per mol of silver. The emulsion was then subjected to optimum chemical sensitization with sodium thiosulfate, potassium chloroaurate and potassium thiocyanate at 60° C. in the presence of the sensitizing dye.

(4) Preparation of coated samples

To a triacetyl cellulose film support having a subbing layer provided thereon were applied an emulsion layer and a protective layer as shown in Table 1 to prepare samples.

TABLE 1

| Emulsion coating conditions |
|---|
| (1) Emulsion layer |
| Emulsion: Emulsion 1 (see Table 2 for the dye used) (silver: $2.1 \times 10^{-2}$ mol/m$^2$) |
| Coupler ($1.5 \times 10^{-3}$ mol/m$^2$) |

TABLE 1-continued

Emulsion coating conditions

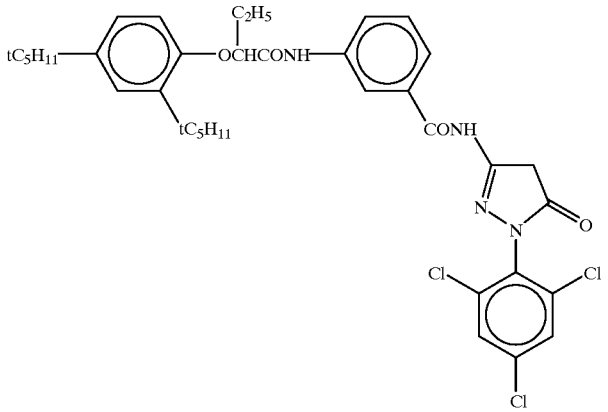

Tricresyl phosphate (1.10 g/m$^2$)
Gelatin (2.30 g/m$^2$)
(2) Protective layer

Sodium salt of 2,4-dichloro-6-hydroxy-s-triazine (0.08 g/m$^2$)
Gelatin (1.80 g/m$^2$)

These samples were each subjected to exposure for sensitometry for 1/100 seconds, and then subjected to color development in the following manner.

Processing method

| Step | Processing time | Processing temperature | Replenishment rate | Tank capacity |
|---|---|---|---|---|
| Color development | 2 min. 45 sec. | 38° C. | 33 ml | 20 l |
| Bleach | 6 min. 30 sec. | 38° C. | 25 ml | 40 l |
| Rinsing | 2 min. 10 sec. | 24° C. | 1,200 ml | 20 l |
| Fixing | 4 min. 20 sec. | 38° C. | 25 ml | 30 l |
| Rinsing (1) | 1 min. 5 sec. | 24° C. | Countercurrent piping system in which water flows from (2) to (1) | 10 l |
| Rinsing (2) | 1 min. | 24° C. | 1,200 ml | 10 l |
| Stabilization | 1 min. 5 sec. | 38° C. | 25 ml | 10 l |
| Drying | 4 min. 20 sec. | 55° C. | | |

The composition of the processing solutions will be described below.

| | Mother liquor (g) | Replenisher (g) |
|---|---|---|
| (Color developer) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylaminesulfate | 2.4 | 2.8 |

-continued

| | Mother liquor (g) | Replenisher (g) |
|---|---|---|
| 4-[N-ethyl-N-β-hydroxyethylamino]-2-methylanilino sulfate | 4.5 | 5.5 |
| Water to make | 1.0 l | 1.0 l |
| pH | 10.05 | 10.05 |
| (Bleach solution) | | |
| Ferric sodium ethylenediamine-tetraacetate trihydrate | 100.0 | 120.0 |
| Disodium ethylenediaminetetraacetate | 10.0 | 11.0 |
| Ammonium bromide | 140.0 | 160.0 |
| Ammonium nitrate | 30.0 | 35.0 |
| 27% Aqueous ammonia | 6.5 ml | 4.0 ml |
| Water to make | 1.0 l | 1.0 l |
| pH | 6.0 | 5.7 |
| (Fixing solution) | | |
| Sodium ethylenediaminetetraacetate | 0.5 | 0.7 |
| Sodium sulfite | 7.0 | 8.0 |
| Sodium bisulfite | 5.0 | 5.5 |
| 70% Aqueous solution of ammonium thiosulfate | 170.0 ml | 200.0 ml |
| Water to make | 1.0 l | 1.0 l |
| pH | 6.7 | 6.6 |
| (Stabilizing solution) | | |
| 37% Formalin | 2.0 ml | 2.0 ml |
| Polyoxyethylene-p-monononylphenyl ether (average polymerization degree: 10) | 0.3 | 0.45 |
| Disodium ethylenediaminetetraacetate | 0.05 | 0.08 |
| Water to make | 1.0 l | 1.0 l |
| pH | 5.8–8.0 | 5.8–8.0 |

The samples thus processed where each measured for density through a green color filter to evaluate the initial sensitivity and residual color after processing.

The sensitivity is defined by the reciprocal of the exposure giving a density of 0.2 higher than fogged density. The sensitivities of these samples were each represented relative to that of Sample 01 as 100. These samples were each visually observed for residual color after processing. For the criterion of evaluation, symbols ◎, ○, X were used in order of insusceptibility to residual color.

The emulsion and sensitizing dye used in the various samples and the results of sensitivity and residual color of the various samples are set forth in Table 2 below.

TABLE 2

| Sample No. | Emulsion | Sensitizing dye compound No. | Sensitivity | Residual color | Remarks |
|---|---|---|---|---|---|
| 01 | Emulsion 1 | SS-1 | 100 (reference) | x | Comparison |
| 02 | " | (1) | 120 | ◎ | Present Invention |
| 03 | " | SS-2 | 104 | x | Comparison |
| 04 | " | (9) | 125 | ◎ | Present Invention |
| 05 | " | SS-3 | 103 | x | Comparison |
| 06 | " | (11) | 124 | ○ | Present Invention |
| 07 | Emulsion 2 | SS-1 | 121 | x | Comparison |
| 08 | " | (1) | 164 | ◎ | Present Invention |
| 09 | " | SS-2 | 125 | x | Comparison |
| 10 | " | (9) | 168 | ◎ | Present Invention |
| 11 | " | SS-3 | 124 | x | Comparison |
| 12 | " | (11) | 169 | ○ | Present Invention |
| 13 | Emulsion 3 | SS-1 | 141 | x | Comparison |
| 14 | " | (1) | 201 | ◎ | Present Invention |
| 15 | " | SS-2 | 145 | x | Comparison |
| 16 | " | (9) | 207 | ◎ | Present Invention |
| 17 | " | SS-3 | 146 | x | Comparison |
| 18 | " | (11) | 208 | ○ | Present Invention |
| 19 | " | SS-4 | 130 | x | Comparison |
| 20 | " | SS-5 | 129 | x | Comparison |
| 21 | " | SS-6 | 127 | x | Comparison |
| 22 | " | SS-7 | 125 | x | Comparison |
| 23 | " | (18) | 158 | ○ | Present Invention |
| 24 | " | SS-8 | 135 | x | Comparison |
| 25 | " | (16) | 175 | ○ | Present Invention |

SS-1

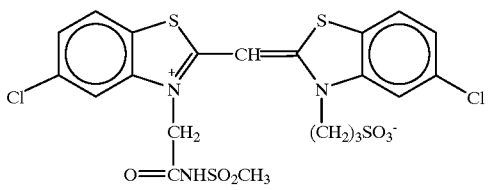

SS-2

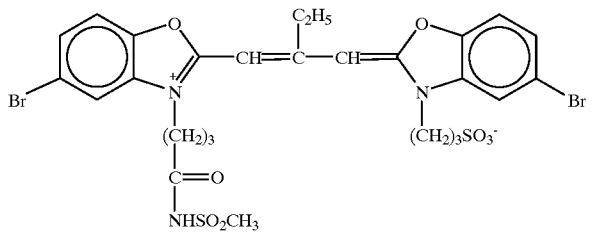

SS-3

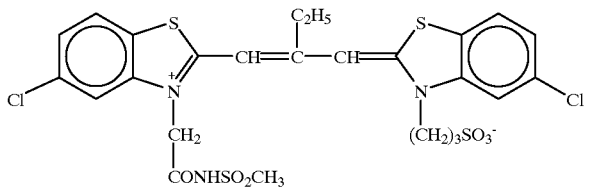

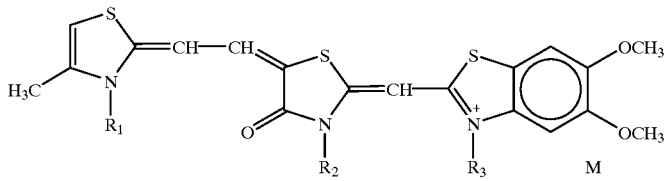

M

TABLE 2-continued

SS-4: $R_1$, $R_3$ = $(CH_2)_4SO_3^-$, $R_2$ = $C_2H_5$, M = $Na^+$
SS-5: $R_1$ = $(CH_2)_4SO_3^-$, $R_2$ = $C_2H_5$, $R_3$ = $CH_2CONHSO_2CH_3$, M = — (none)
SS-6: $R_1$, $R_3$ = $(CH_2)_4SO_3^-$, $R_2$ = $CH_2CO_2^-$, M = $2Na^+$
SS-7: $R_1$ = $(CH_2)_3SO_3^-$, $R_2$, $R_3$ = $CH_2CO_2^-$, M = $2K^+$

SS-8

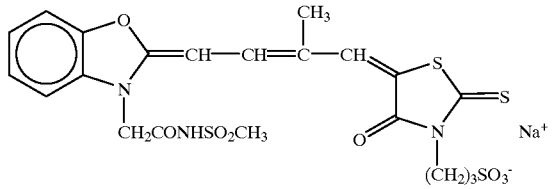

As can be seen in Table 2, the compounds according to the present invention provide a higher initial sensitivity and exhibit less residual color than the comparative compounds. It can also be seen that when the aspect ratio of the emulsion is raised, the resulting photographic light-sensitive material exhibits a remarkably enhanced sensitivity.

EXAMPLE 2

An emulsion of tabular silver bromoiodide grains was prepared as Emulsion 3 in the same manner as Emulsion D of Example 5 in JP-A-8-29904.

A multi-layer color photographic material was prepared in the same manner as Sample 101 of Example 5 in JP-A-8-29904. Samples 201 and 202 were prepared in the same manner as Sample 101 of Example 5 in JP-A-8-29904 except that Emulsion D to be incorporated in the 5th layer was replaced by Emulsion 3 and ExS-1, 2 and 3 were replaced by the sensitizing dye (SS-3) ($5.0\times10^{-4}$ mol/mol-Ag) or the sensitizing dye (11) ($5.0\times10^{-4}$ mol/mol-Ag).

In order to examine the samples thus obtained for sensitivity, these samples were each exposed to light from a Fuji EW type sensitometer (produced by Fuji Photo Film Co., Ltd.) through an optical wedge and a red color filter for 1/100 seconds, subjected to color development processing with the same processing solutions in the same manner as in Example 1 of JP-A-8-29904, and then measured for cyan density. The sensitivity was represented as relative value of (fog density +0.2).

As a result, Sample 202 of the present invention exhibited a sensitivity as high as 121 relative to that of Comparative Sample 201 as reference (100). Sample 202 exhibited less residual color.

EXAMPLE 3

Emulsions of tetradecahedral silver bromoiodide grains were prepared as Emulsions 301 and 302 in the same manner as in Emulsion 1 of Example 1 in JP-A-7-92601 except that the spectral sensitizing dye was replaced by the sensitizing dye (SS-2) (8×10–4 mol/mol-Ag) and the sensitizing dye (9) ($8\times10^{-4}$ mol/mol-Ag), respectively. Further, emulsions of cubic silver bromoiodide grains were prepared as Emulsions 303 and 304 in the same manner as in Emulsion 1 of Example 1 in JP-A-7-92601 except that the silver potential in the second time double jet was changed from +65 mV to +115 mV and the spectral sensitizing dye was replaced by the sensitizing dye (SS-2) ($8\times10^{-4}$ mol/mol-Ag) and the sensitizing dye (9) ($8\times10^{-4}$ mol/mol-Ag), respectively.

A multi-layer color photographic material was prepared in the same manner as Sample 401 of Example 4 in JP-A-7-92601. Samples 311 and 312 were prepared in the same manner as Sample 401 of Example 4 in JP-A-7-92601 except that Emulsion 1 to be incorporated in the 9th layer was replaced by Emulsion 301 and Emulsion 302, respectively. Similarly, Samples 313 and 314 were prepared in the same manner as Sample 401 of Example 4 in JP-A-7-92601 except that Emulsion 1 to be incorporated in the 9th layer was replaced by Emulsion 303 and Emulsion 304, respectively.

The various samples thus obtained were then evaluated for sensitivity. In some detail, these samples were each subjected to 1/50 second exposure and color reversal development processing in the same manner as in Example 4 of JP-A-7-92601, and then measured for yellow density. The sensitivity is defined as the reciprocal of the exposure required to give a density of the lowest density obtained at sufficient exposure plus 0.2. The sensitivity of these samples were represented relative to that of Comparative Sample 311 as 100. As a result, Sample 312 of the present invention exhibited a sensitivity as high as 136 and less residual color after processing. Similarly, Sample 314 exhibited a sensitivity as high as 134 relative to that of Comparative Sample 313 as 100 and less residual color after processing.

EXAMPLE 4

An internal latent image type direct positive emulsion of octahedral silver bromide grains and an internal latent image type direct positive emulsion of hexagonal tabular silver bromide grains were prepared as Emulsion 401 and Emulsion 402 in the same manner as Emulsion 1 and Emulsion 5 of Example 1 in JP-A-5-313297, respectively.

A color diffusion transfer photographic film was prepared in the same manner as Sample 101 of Example 1 in JP-A-5-313297. Samples 411 and 412 were prepared in the same manner as Sample 101 of Example 1 in JP-A-5-313297 except that Emulsion-2 and the sensitizing dye (2) to be incorporated in the 16th layer were replaced by Emulsion 401 and the sensitizing dye (SS-1) ($9\times10^{-4}$ mol/mol-Ag) and the sensitizing dye (1) ($9\times10^{-4}$ mol/mol-Ag), respectively.

In order to examine the samples thus obtained for sensitivity, these samples were each subjected to exposure and processing using the same processing solution at the same processing steps as in Example 1 of JP-A-5-313297, and then measured for transfer density by means of a color densitometer. The sensitivity is represented by relative value at a density of 1.0. Sample 412 of the present invention exhibited a sensitivity as high as 124 relative to that of Comparative Sample 411 as 100 and less residual color after processing.

EXAMPLE 5

Emulsions of silver bromochloride grains were prepared as Emulsion 501 and Emulsion 502 in the same manner as Emulsion F of Example 2 in JP-A-4-142536 except that the red-sensitive sensitizing dye (S-1) was not added before sulfur sensitization, optimum gold sulfur sensitization was effected with chloroauric acid in addition to sulfur sensitization with triethylurea and the gold sulfur sensitization was followed by the addition of the sensitizing dye (SS-3) ($2\times10^{-4}$ mol/mol-Ag) and the sensitizing dye (11) ($2\times10^{-4}$ mol/mol-Ag), respectively.

A multi-layer color photographic paper was prepared in the same manner as Sample 20 of Example 1 in JP-A-6-347944. Samples 511 and 512 were prepared in the same manner as Sample 20 of Example 1 in JP-A-6-347944 except that the emulsion to be incorporated in the 5th layer was replaced by Emulsion 501 and Emulsion 502, respectively.

In order to examine the samples thus obtained for sensitivity, these samples were each exposed to light from a Fuji FW type sensitometer (produced by Fuji Photo Film Co., Ltd.) through an optical wedge and a red color filter for 1/10 seconds, and then subjected to color development with the same processing solutions in the same manner as in Example 1 of JP-A-6-347944. As a result, Sample 512 of the present invention exhibited a sensitivity as high as 138 relative to that of Comparative Sample 511 as reference (100) and less residual color after processing.

EXAMPLE 6

Emulsions of tabular silver chloride grains were prepared as Emulsion 601 and Emulsion 602 in the same manner as in Example 1 of JP-A-8-122954 except that the chemical sensitization (B) was effected with the sensitizing dye (SS-2) ($2\times10^{-4}$ mol/mol-Ag) and the sensitizing dye (9) ($2\times10^{-4}$ mol/mol-Ag) instead of the sensitizing dye-1 and the sensitizing dye-2, respectively.

Coated samples were prepared as Sample 611 and Sample 612 by applying an emulsion layer and a surface protective layer in combination to both the surfaces of a support by a simultaneous extrusion method in the same manner as in Example 1 of JP-A-8-122954 except that the emulsion used were replaced by Emulsion 601 and Emulsion 602, respectively. The amount of silver to be applied per each surface was 1.75 g/m$^2$.

In order to examine the samples thus obtained for sensitivity, these samples were each subjected to exposure on both surfaces thereof for 0.05 seconds using an X-ray orthoscreen HGM produced by Fuji Photo Film Co., Ltd., and then subjected to processing using the same automatic developing machine with the same processing solutions as used in Example 1 of JP-A-8-122954. The sensitivity was represented by the logarithm of the reciprocal of the exposure giving a density of (fog +0.1), relative to that of Sample 611 as 100. As a result, Sample 612 of the present invention exhibited a sensitivity as high as 131 and less residual color after processing.

Similar effects were obtained with the case where exposure was effected using an X-ray orthoscreen HR-4 or HGH instead of X-ray orthoscreen HGM.

EXAMPLE 7

An emulsion of tabular silver chloride grains was prepared as Emulsion 701 in the same manner as Emulsion D of Example 2 of JP-A-8-227117 except that the sensitizing dye-2 and the sensitizing dye-3 were not added.

Coated samples were prepared in the same manner as Coated Sample F of Example 3 of JP-A-8-227117. Sample 711 and Sample 712 were prepared in the same manner as Coated Sample F of Example 3 in J P-A-8-227117 except that Emulsion F was replaced by Emulsion 701 and the sensitizing dye-1 was replaced by the sensitizing dye (SS-1) ($5\times10^{-4}$ mol/mol-Ag) and the sensitizing dye (1) ($5\times10^{31\ 4}$ mol/mol-Ag), respectively.

In order to examine the samples thus obtained for sensitivity, these samples were each subjected to 1/100 second exposure to light from a Fuji EW type sensitometer (produced by Fuji Photo Film Co., Ltd.) through an optical wedge and a blue color filter, and then subjected to Fuji Photo Film CN16 processing. The samples thus processed were then compared for photographic properties.

The sensitivity was represented by the logarithm of the reciprocal of the exposure giving a density of (fog+0.2), relative to that of Sample 711 as 100. As a result, Sample 712 of the present invention exhibited a sensitivity as high as 125 and less residual color after processing.

EXAMPLE 8

An emulsion of octahedral silver chloride grains was prepared as Emulsion 801 in the same manner as Emulsion F of Example 3 of JP-A-8-227117.

Coated samples were prepared in the same manner as Coated Sample F of Example 3 of JP-A-8-227117. Sample 811 and Sample 812 were prepared in the same manner as Coated Sample F of Example 3 in JP-A-8-227117 except that Emulsion F was replaced by Emulsion 801 and the sensitizing dye-1 was replaced by the sensitizing dye (SS-3) ($5\times10^{-4}$ mol/mol-Ag) and the sensitizing dye (11) ($5\times10^{-4}$ mol/mol-Ag), respectively.

In order to examine the samples thus obtained for sensitivity, these samples were each subjected to 1/100 second exposure to light from a Fuji EW type sensitometer (produced by Fuji Photo Film Co., Ltd.) through an optical wedge and a red color filter, and then subjected to Fuji Photo Film CN16 processing. The samples thus processed were then compared for photographic properties. The sensitivity was represented by the logarithm of the reciprocal of the exposure giving a density of (fog+0.2), relative to that of Sample 811 as 100. As a result, Sample 812 of the present invention exhibited a sensitivity as high as 129 and less residual color remaining after processing.

EXAMPLE 9

An emulsion of tabular grains was prepared in the same manner as Emulsion CC of European Patent No. 0699950. The emulsion thus prepared was then subjected to chemical sensitization with the sensitizing dye (SS-2) in an amount of $5\times10^{-4}$ mol/mol-Ag instead of Dye 1 and Dye 8. To the emulsion thus chemically sensitized was then added the sensitizing dye (SS-2) in an amount of $3\times10^{-4}$ mol/mol-Ag. To the emulsion was then further added the sensitizing dye (SS-2) in an amount of $3\times10^{-4}$ mol/mol-Ag to prepare Emulsion 901. Separately, the emulsion of tabular grains was subjected to chemical sensitization with the sensitizing dye (9) in an amount of $5\times10^{-4}$ mol/mol-Ag instead of Dye 1 and Dye 8. To the emulsion thus chemically sensitized was then added the sensitizing dye (9) in an amount of $3\times10^{-4}$ mol/mol-Ag. To the emulsion was then further added the sensitizing dye (9) in an amount of $3\times10^{-4}$ mol/mol-Ag to prepare Emulsion 902.

Coated samples 911 and 912 were then prepared in the same manner as in the example of European Patent No.

0699950 except that Emulsions 901 and 902 were used, respectively. These samples were each subjected to exposure and development in the same manner as described in the above cited patent. The samples thus processed were then compared for photographic properties. The sensitivity was represented by the logarithm of the reciprocal of the exposure giving a density of (fog+0.2), relative to that of Sample 911 as 100. As a result, Sample 912 of the present invention exhibited a sensitivity as high as 125 and less residual color after processing.

In accordance with the present invention, a silver halide photographic light-sensitive material which exhibits a high sensitivity and less residual color can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one light-sensitive silver halide emulsion layer, wherein said silver halide emulsion layer comprises at least one sensitizing dye represented by the following general formula (I):

(I)

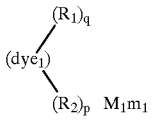

wherein dye1 represents a methine dye; $M_1$ represents a charge-balanced counter ion; $m_1$ represents the number of $M_1$ required to neutralize the charge of the molecule; q and p each represents an integer of 1 or more; $R_1$ represents a substituted alkyl group represented by $R_{1a}$, $R_{1b}$, $R_{1c}$ or $R_{1d}$:

$R_{1a}$: $(Qa)rCON^{-SO}{}_2Ra$ $R_{1b}$: $(Qb)sSO_2N^-CORb$ $R_{1c}$: $(Qc)tCON^-CORc$ $R_{1d}$: $(Qd)uSO_2N^{-SO}{}_2Rd$ wherein Ra, Rb, Rc and Rd each represents an unsubstituted alkyl group having from 1 to 18 carbon atoms; Qa, Qb, Qc and Qd each represents a methylene group; and r, s, t and u each represents an integer of 1 or more; and $R_2$ represents a substituted alkyl group represented by the following general formula $R_{2a}$ or $R_{2b}$:

$R_{2a}$: $A_1—SO_3^-$ $R_{2b}$: $A_2—X$ wherein $A_1$ represents a connecting group containing at least one alkylene group and at least one atom other than carbon atom; $A_2$ represents a connecting group containing at least one alkylene group; and X represents a carboxyl group, sulfate group, phosphoric acid group or boric acid group.

2. The silver halide photographic light-sensitive material according to claim 1, wherein $A_2$ in $R_2$ represents a connecting group containing at least one atom other than carbon atom.

3. The silver halide photographic light-sensitive material according to claim 1 or 2, wherein said at least one compound represented by general formula (I) is contained in a silver halide emulsion which comprises silver halide grains having an aspect ratio of from not less than 3 to not more than 100 in a proportion of 50% or more based on the total projected area of the silver halide grains.

4. The silver halide photographic light-sensitive material according to claim 1, wherein said compound represented by the general formula (I) is represented by the following general formula (X):

(X)

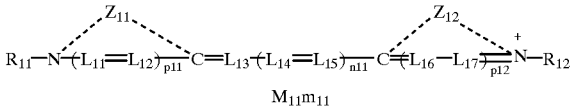

wherein $L_{11}$, $L_{12}$, $L_{13}$, $L_{14}$, $L_{15}$, $L_{16}$ and $L_{17}$ each represents a methine group; $P_{11}$ and $P_{12}$ each represents 0 or 1; $n_{11}$ represents 0, 1, 2 or 3; $Z_{11}$ and $Z_{12}$ each represents an atomic group required to form a 5- or 6-membered nitrogen-containing heterocyclic group, with the proviso that said heterocyclic group may be condensed with aromatic rings; $M_{11}$ represents a charge-balanced counter ion; $m_{11}$ represents a number of from 0 to 4 required to neutralize the charge of the molecule; $R_{11}$ has the same meaning as $R_1$; and $R_{12}$ has the same meaning as $R_2$.

5. The silver halide photographic light-sensitive material according to claim 4, wherein $A_2$ in $R_{12}$ represents a connecting group containing at least one atom other than carbon atom.

6. The silver halide photographic light-sensitive material according to claim 4 or 5, wherein said compound represented by general formula (X) is contained in a silver halide emulsion which comprises silver halide grains having an aspect ratio of from not less than 3 to not more than 100 in a proportion of 50% or more based on the total projected area of the silver halide grains.

7. The silver halide photographic light-sensitive material according to claim 1, wherein at least one $R_2$ is $R_{2a}$.

8. The silver halide photographic light-sensitive material according to claim 1, wherein at least one $R_2$ is $R_{2b}$.

9. The silver halide photographic light-sensitive material according to claim 1, wherein Ra, Rb, Rc and Rd each represents an unsubstituted methyl group.

* * * * *